US008195056B2

(12) United States Patent
Misawa

(10) Patent No.: US 8,195,056 B2
(45) Date of Patent: Jun. 5, 2012

(54) FIXING APPARATUS, PRINTING APPARATUS, AND COMPUTER READABLE MEDIUM STORING A PROGRAM FOR DETECTING TWINE

(75) Inventor: Satoshi Misawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 532 days.

(21) Appl. No.: 12/339,594

(22) Filed: Dec. 19, 2008

(65) Prior Publication Data

US 2009/0252506 A1 Oct. 8, 2009

(30) Foreign Application Priority Data

Apr. 2, 2008 (JP) ..... 2008-096444
Apr. 2, 2008 (JP) ..... 2008-096445

(51) Int. Cl.
*G03G 15/20* (2006.01)

(52) U.S. Cl. ..... 399/33

(58) Field of Classification Search ..... 399/33, 399/66–70, 94, 320–323, 411; 219/216
See application file for complete search history.

(56) References Cited

U.S. PATENT DOCUMENTS

2005/0254846 A1 11/2005 Yura et al.
2007/0189786 A1* 8/2007 Aoki et al. ..... 399/33
2008/0118262 A1* 5/2008 Kinouchi et al. ..... 399/69

FOREIGN PATENT DOCUMENTS

JP 06-089067 A 3/1994
JP 9-185274 A 7/1997
JP 11-296015 A 10/1999
JP 2005-326524 A 11/2005
JP 2007-017539 A 1/2007

OTHER PUBLICATIONS

Japanese Office Action dated Jan. 12, 2010 for Japanese Application No. 2008-096444 and English language translation.

* cited by examiner

*Primary Examiner* — David Gary
*Assistant Examiner* — Ruth Labombard
(74) *Attorney, Agent, or Firm* — Sughrue Mion, PLLC

(57) ABSTRACT

The present invention provides a fixing apparatus including: a pair of rotating bodies that transports a recording medium on which an image is formed by using an image forming material, by sandwiching the recording medium; a heating section that heats at least one of the pair of rotating bodies; a moving section that moves the pair of rotating bodies between a position at which they mutually contact and a position at which they are mutually separated; a temperature detecting section that detects a surface temperature of at least one of the pair of rotating bodies without contacting the rotating bodies; and a twine generation determining section that determines whether the recording medium has twined around either one of the pair of rotating bodies based on a rate of temperature increase after a temperature decrease of the surface temperature detected by the temperature detecting section.

7 Claims, 15 Drawing Sheets

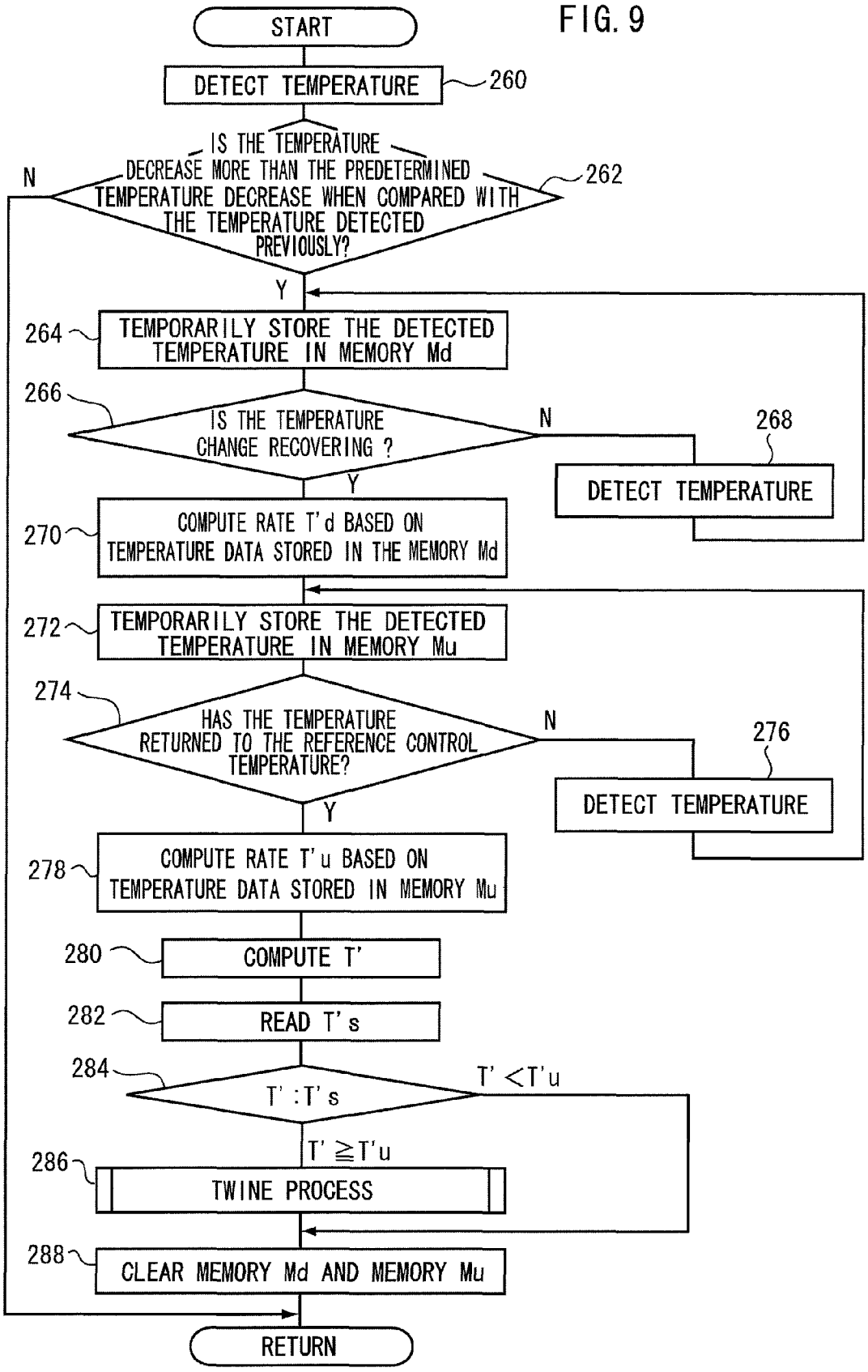
FIG. 9
START
DETECT TEMPERATURE
260
IS THE TEMPERATURE DECREASE MORE THAN THE PREDETERMINED TEMPERATURE DECREASE WHEN COMPARED WITH THE TEMPERATURE DETECTED PREVIOUSLY?
262
N
Y
264
TEMPORARILY STORE THE DETECTED TEMPERATURE IN MEMORY Md
266
IS THE TEMPERATURE CHANGE RECOVERING ?
N
268
DETECT TEMPERATURE
Y
270
COMPUTE RATE T'd BASED ON TEMPERATURE DATA STORED IN THE MEMORY Md
272
TEMPORARILY STORE THE DETECTED TEMPERATURE IN MEMORY Mu
274
HAS THE TEMPERATURE RETURNED TO THE REFERENCE CONTROL TEMPERATURE?
N
276
DETECT TEMPERATURE
Y
278
COMPUTE RATE T'u BASED ON TEMPERATURE DATA STORED IN MEMORY Mu
280
COMPUTE T'
282
READ T's
284
T' :T's
T' <T'u
T' ≧T'u
286
TWINE PROCESS
288
CLEAR MEMORY Md AND MEMORY Mu
RETURN

FIXING APPARATUS, PRINTING APPARATUS, AND COMPUTER READABLE MEDIUM STORING A PROGRAM FOR DETECTING TWINE

CROSS-REFERENCE TO RELATED APPLICATION

This application is based on and claims priority under 35 USC 119 from Japanese Patent Application No. 2008-096444 filed Apr. 2, 2008 and Japanese Patent Application No. 2008-096445 filed Apr. 2, 2008.

BACKGROUND

1. Technical Field

The present invention relates to a fixing apparatus, a printing apparatus, and a computer readable medium storing a program for detecting twine.

2. Related Art

In an image processing apparatus, a fixing apparatus sandwiching a recording medium between a rotating body having a heat source and a rotating body for pressurizing is mounted, wherein the fixing apparatus fixes an image forming material, such as a toner or the like, that are transferred to the recording medium. The rotating body having the heat source applies a heat to the recording medium, and the rotating body for pressurizing is arranged to oppose to the rotating body having the heat source.

In this fixing apparatus, there is a case where the recording medium twine around the heating member (or the pressurizing member) due to various factors, such a static electricity of the recording medium, an adhesive property of the toner, an oil supplied at a time of fixing, or the like.

Accordingly, in order to detect the twine of the recording medium to any one of a pair of rotating bodies, arranging an optical type sensor and monitoring the twine of the recording medium based on a result of detection of the optical type sensor is considered. However, when twine occurs, a periphery of the fixing section, the heating member and the pressurizing member comes to have a high temperature. Accordingly, position for arranging the optical sensor shall be limited, for example, arranging the optical type sensor at a far position or the like shall be necessary.

SUMMARY

According to a first aspect of the invention, there is provided a fixing apparatus including: a pair of rotating bodies that transports a recording medium on which an image is formed by using an image forming material, by sandwiching the recording medium; a heating section that heats at least one of the pair of rotating bodies; a moving section that moves the pair of rotating bodies between a position at which they mutually contact and a position at which they are mutually separated; a temperature detecting section that detects a surface temperature of at least one of the pair of rotating bodies without contacting the rotating bodies; and a twine generation determining section that determines whether the recording medium has twined around either one of the pair of rotating bodies based on a rate of temperature increase after a temperature decrease of the surface temperature detected by the temperature detecting section.

BRIEF DESCRIPTION OF THE DRAWINGS

Exemplary embodiments of the present invention will be described in detail based on the following figures, wherein:

FIG. 9 is a flow chart showing control routine for monitoring a twine in a twine monitoring control section in accordance with the second exemplary embodiment;

DETAILED DESCRIPTION

First Embodiment

Figure 1:
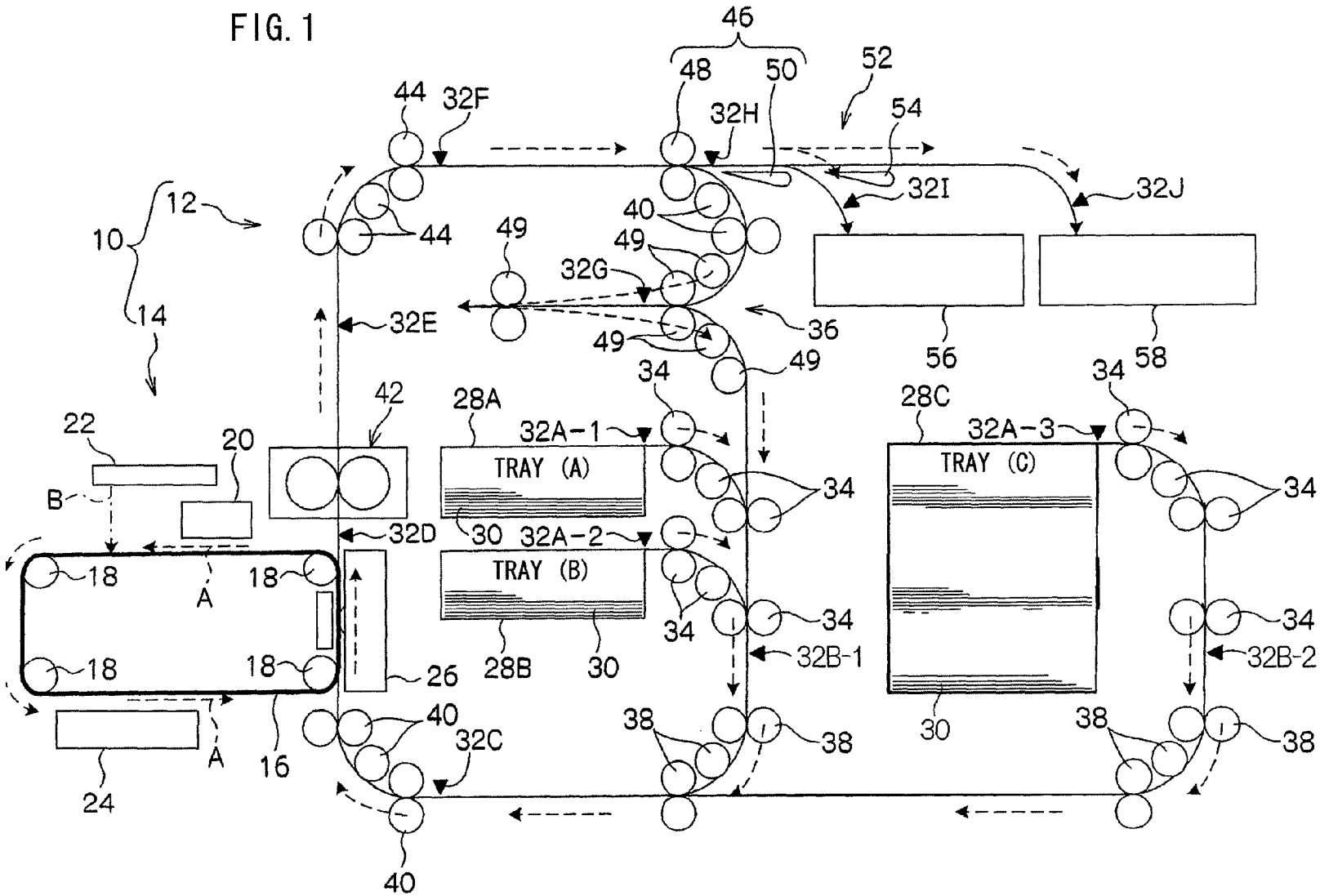
FIG. 1 is an outline structure of an image forming apparatus in accordance with a first exemplary embodiment.

FIG. 1 is an outline structure of an image processing apparatus 10 in accordance with a first exemplary embodiment.

The image processing apparatus 10 includes an image forming section 14 arranged adjacent to a paper transport section 12.

(Image Forming Section 14)

The image forming section 14 is used as an example of the image forming section. Further, a toner is used as an example of the image forming material, and a recording paper 30 is used as the recording medium.

The image forming section 14 forms an image on the recording paper 30 by using the toner. Specifically, the image forming section 14 is provided with an endless loop-shaped transfer belt (an image retaining body) 16. The transfer belt 16 is wound around the plural rollers 18, and is configured rotate in a direction of arrow A in FIG. 1 (a counterclockwise direction in FIG. 1) in an approximately rectangular shape, by a driving force form a drive motor (not shown).

In an upper side section of the transfer belt 16 (an upper side of a horizontal transport region), an electrostatic charging apparatus 20 is arranged in an upstream side along a transport direction of the transfer belt 16, and a light scanning apparatus 22 is arranged in a downstream side, so as to oppose to each other.

The electrostatic charging apparatus 20 is configured to uniformly electrostatic-charge a surface of the transfer belt 16.

On the other hand, the light scanning apparatus 22 controls turning on and off a laser, serving as the light source (hereinafter, refer to as "lighting control") based on an input image data. Further, the light scanning apparatus 22 deflects the lighting of the controlled light beam to repeatedly scan in one direction. This deflecting direction corresponds to a main scanning direction, and is shown as a depth direction in FIG. 1 (a direction which is orthogonal to the transport direction of the transfer belt 16).

Accordingly, the transport direction of the transfer belt 16 is the sub scanning direction with respect to the main scanning direction.

The light beam mainly scanned from the light scanning apparatus 22 is output (refer to an arrow B in FIG. 1) while circulating the transfer belt 16 uniformly electrostatic-charged by the electrostatic charging apparatus 20 at a predetermined transport speed. Accordingly, it is possible to form an electrostatic image in a predetermined plane region on the transfer belt 16.

A developing apparatus 24 developing by supplying the toner serving as a developing material to an electrostatic latent image is provided in a lower side section in the transfer belt 16 (a lower side of the horizontal transport region).

The formed image (the toner image) developed by the developing apparatus 24 is sent to the transfer section 26 in the right side section (the right side of the vertical transport region) respective to the transport direction of the transfer belt 16. In this transfer section 26, the toner image is transferred to the recording paper 30 as mentioned below, and the transfer belt 16 is thereafter returned to the electrostatic charging apparatus 20 via a cleaning section (not shown) (an end of one cycle).

In the image forming section 14, the image forming process is repeated, by circulating the transfer belt 16.

(Paper Transport Section 12)

As shown in FIG. 1, a center of the paper transport section 12 is provided with upper and lower stages of tray 28A and tray 28B. Further, a tray 28C is provided, having several folded papers holding capacity, compared to the tray 28A and the tray 28B. In the case of generically naming, the tray 28A, the tray 28B and the tray 28C, are hereinafter refer to as "tray 28".

For example, the trays 28 are stacked with the recording papers (mediums) 30 having different sizes.

Further, the trays 28 are all configured such that a right end section side in FIG. 1 is set to a take-up side of the recording paper, and are respectively provided with tray sensors 32A-1 (for the tray 28A), 32A-2 (for the tray 28B) and 32A-3 (for the tray 28C) for detecting a leading end of the recording paper 30 just after being picked up.

The recording paper 30 picked up from the tray 28 is guided by the plural rollers 34, which is diverted in a clockwise forward direction in FIG. 1 at an approximately 90 degree, and is carried down ward in FIG. 1.

Downward transport sensors 32B-1 and 32B-2 are provided at predetermined positions in the downward transport. This downward transport sensor 32B-1 detects the recording paper 30 carried from the tray 28A or 28B or a double-sided printing transport section 36, as mentioned below.

Plural rollers 38 are provided in a downstream side of the downward transport sensors 32B-1 and 32B-2. The recording paper 30 is guided in the clockwise forward direction in FIG. 1 at an approximately 90 degree by the plural rollers 38, and is carried approximately horizontally at a predetermined length.

A transfer synchronization detecting sensor 32C is provided in a down stream side of the horizontal transport region. The transfer synchronization detecting sensor 32C synchronize (timing) to normally transfer the toner image to a predetermined region of the recording paper 30. The recording paper 30 is stopped when the leading end is detected by the transfer synchronization detecting sensor 32C as occasion demands, and stands ready.

Plural rollers 40 are provided in a downstream side of the transfer synchronization detecting sensor 32C. The recording paper 30 is guided in the clockwise direction in FIG. 1 at an approximately 90 degree by the plural rollers 40, and is carried upward.

The transfer section 26 mentioned above is arranged in the midstream of the upward transport path. In the transfer section 26, the recording paper 30 is closely attached to the transfer belt 16 at a predetermined pressure, and the toner is transferred to the recording paper 30 from the transfer belt 16 by an electrostatic effect. As a result, the image is transferred onto the recording paper 30.

A fixing section 42 constructing a part of the image forming section 14 is provided in a down stream side (an upper side of an upward transport direction) of the transfer section 26, and fixes the toner image to the recording paper 30 surface by receiving the recording paper 30, and transporting out a fixing process of applying predetermined heat and pressure.

A before fixing detection sensor 32D is provided on a transport path between the fixing section 42 and the transfer section 26. The before fixing detection sensor 32D detects the leading end of the recording paper 30 received in the fixing section 42. For example, the before fixing detection sensor 32D controls a temperature within the fixing section 42 or achieves a start timing of a mechanical motion for pressurizing.

A after fixing detection sensor 32E is provided in a down stream side in the recording paper transport direction of the fixing section 42. The after fixing detection sensor 32E detects the end of the fixing process in the fixing section 42.

A plural rollers 44 are provided in a downstream side of the after fixing detection sensor 32E. The recording paper 30 is guided in the clockwise forward direction in FIG. 1 at an approximately 90 degree by the plural rollers 44, and is carried approximately horizontally.

A print surface discriminating sensor 32F is provided on the transport path just after the approximately horizontal transport. The print surface discriminating sensor 32F detects instruction information of one-sided print or double-sided print which is previously applied to the recording paper 30. A result of detection in the print surface discriminating sensor 32F, applies a requirement for switching the transport direction (switching a point) to a branch section of the transport path as mentioned below.

In the transport path, transporting the recording paper 30 in an approximately horizontal state by the transport roller 42, a first branch section 46 is provided in a downstream side of the print surface discriminating sensor 32F. The first branch section 46 is constructed by the plural transport rollers 48 and switching points 50.

The currently carried recording paper 30 is classified into mode 1 corresponding to a case where only the print of one side is finished in the double-sided print instruction, and mode 2 corresponding to the case where the print of both sides are finished in the double-sided print instruction, based on the information obtained by the print surface discriminating sensor 32F.

In the case of mode 1, the recording paper 30 is diverted in the clockwise direction in FIG. 1 at an approximately 90 degree by the transport roller 48 by switching control of point 50.

Further, in the case of mode 2, the recording paper 30 is maintained its approximately horizontal transport by the transport roller 48 by switching control of the point 50.

The recording paper 30 diverted at an approximately 90 degree, in accordance with the mode 1 mentioned above, is sent to the double-sided printing transport section 36. The double-sided printing transport section 36 is diverted by the plural transport rollers 49. Next, transport timing is controlled by a double-sided print recording paper detecting sensor 32G, and the recording paper is converged with the transport path of the recording paper 30 picked up from the tray 28.

A quality determining sensor 32H is provided in the transport path at a time of maintaining the approximately horizontal transport in accordance with the mode 2 mentioned above. The quality determining sensor 32H reads a result of determining the quality with regard to the printing process.

The quality detecting sensor 32H detects by marking when the cases mentioned below are generated. For example, it may detect when the amount of the toner is not appropriate, when fixing is insufficient, or when there is a transport error (a diagonal transport, a parallel movement, a double sending and the like). A sensor unit having a control function to directly detect and determine an image density, a paper position or the like may also be provided.

A second branch section 52 is provided in an approximately horizontal transport path in a downstream side of the quality determining sensor 32H. The second branch section 52 is provided with a switching point 54.

The currently carried recording paper 30 is determined into a non-defective unit or defective unit based on the information obtained by the quality determining sensor 32H.

In the case of the non-defective unit determination, the recording paper 30 is guided to a tray 56 in an upstream side in the transport direction (a left side in FIG. 1) by the switching control of the point 50. The number of sheets of the recording paper 30 discharged to the tray 56 is counted by a count sensor 32I.

Further, in the case of the defective unit determination, the recording paper 30 is guided to a tray 58 in a down stream side of the transport direction (a right side in FIG. 1) by the switching control of the point 50. The number of sheets of the recording paper 30 discharged to the tray 58 is counted by a count sensor 32J.

(Control System of Image Processing Apparatus 10)

Figure 2:
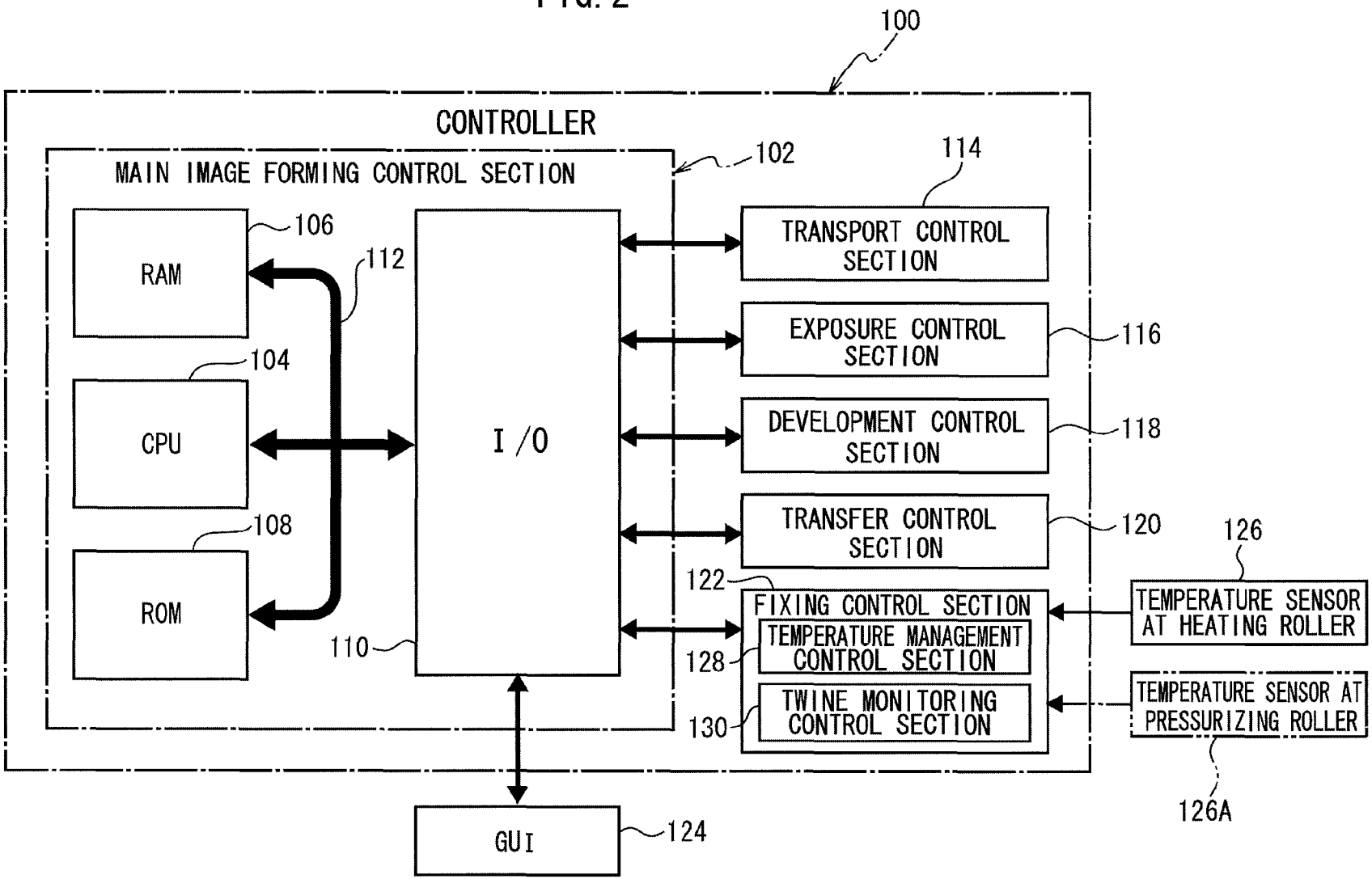
FIG. 2 is a block diagram showing a hardware structure of a control system of the image forming apparatus in accordance with the first exemplary embodiment.

As shown in FIG. 2, the image processing apparatus 10 is configured to be controlled by a controller 100.

The controller 100 is provided with a main image forming control section 102 generally managing all the processes and controls.

The main image forming control section 102 has a CPU 104, an RAM 106, an ROM 108, an I/O (an input and output section) 110, and a bus 112 such as a data bus or a control bus connecting the above.

The CPU 104 reads out various programs, for controlling the fixing section, stored in the ROM 108, and executes a process as mentioned below. In this case, the program may be stored in a portable memory medium such as a CD-ROM or the like.

A transport control section 114, an exposure control section 116, a development control section 118, a transfer control section 120, and a fixing control section 122 are connected to the I/O 110.

The transport control section 114 carries out a control relating to the transport of the recording paper 30 in the paper transport section 12. The exposure control section 116 and the development control section 118 carries out the control relating to the image forming process in the image forming section 14. The transfer control section 120 carries out the image transfer control to the recording paper 30 at a contact point between the image forming section 14 and the paper transport section 12. The fixing control section 122 carries out the control relating to the fixing process of the image transferred recording paper 30.

A graphic user interface (GUI) 124 is connected to the I/O 110. The GUI 124 accepts an input instruction from a user, and informs the user the information relating to the image process.

In the image processing apparatus 10 having the structure mentioned above, in the first exemplary embodiment, there is carried out the control relating to a monitor of the defective transport at a time of the fixing process of the recording paper 30 in the fixing section 42. A description will be given of a detailed structure of the fixing section 42, before explaining the monitoring control of the defective transport.

(Detailed Structure of Fixing Section 42)

Figure 3:
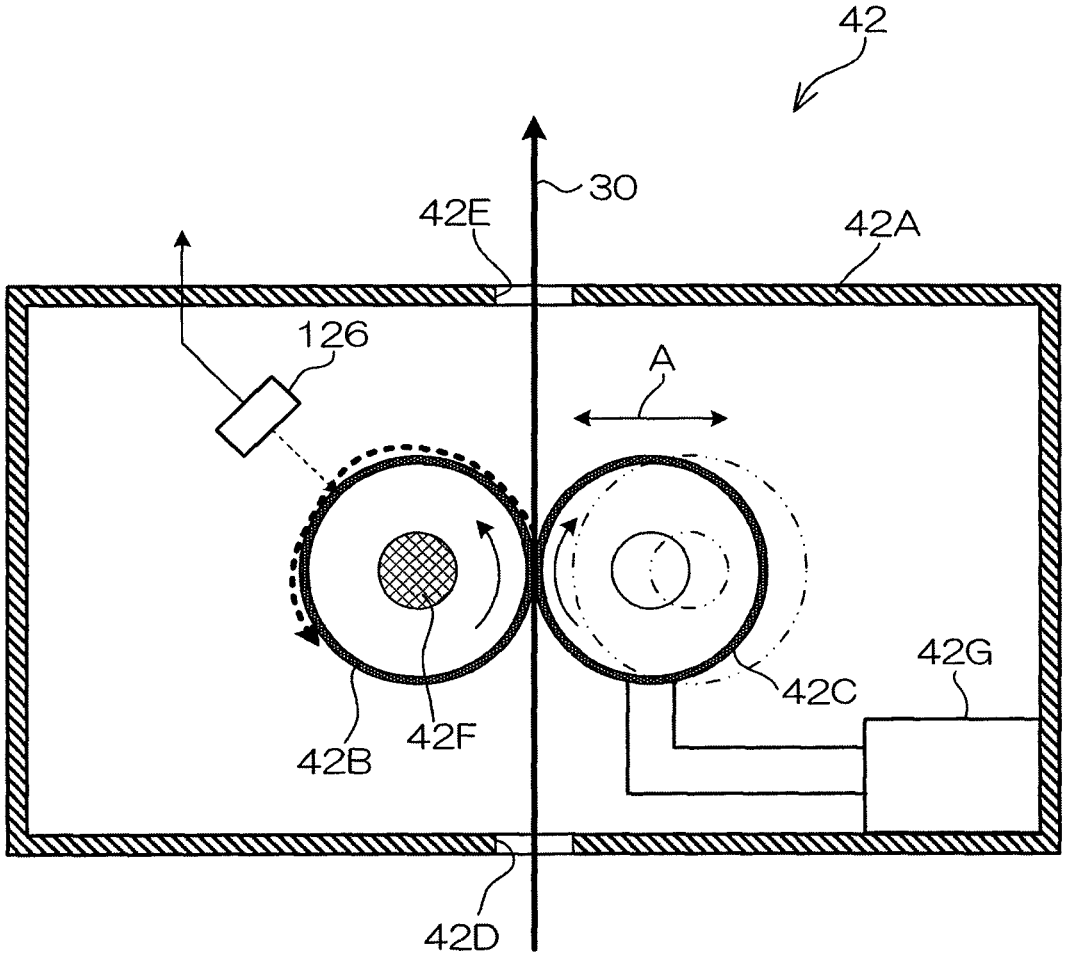
FIG. 3 is an enlarged view showing a detailed structure of a fixing section.

FIG. 3 shows a detailed structure of the fixing section 42 in accordance with the first exemplary embodiment. The fixing section 42 is covered by a casing 42A. Pair of rolls (a heating roller 42B and a pressurizing roller 42C) are arranged within the casing 42A. The pair of rolls (the heating roller 42B and the pressurizing roller 42C) carries the recording paper while sandwiching the recording paper.

A moving mechanism 42G is used as the moving section, and moves the heating roller 42B and the pressurizing roller 42C between a position where they mutually contact and a position where they are mutually separated.

The heating roller 42B and the pressurizing roller 42C are configured to mutually contact or mutually separated by the moving mechanism 42G.

In this case, in the first exemplary embodiment, only the pressurizing roller 42C is movable in the direction of arrow A in FIG. 3.

When the heating roller 42B and the pressurizing roller 42C mutually contact, they are in surface contact with each other based on a surface elastic force. However, FIG. 3 illustrates a state in which they are in line contact with each other along an axial direction. In the case of seeing from a front surface of FIG. 3, the heating roller 42B and the pressurizing roller 42C are in point contact with each other.

Through holes 42D and 42E are provided in the casing 42A corresponding to a tangential direction of a contact point between the heating roller 42B and the pressurizing roller 42C, and forming a space through which the recording paper 30 passes.

The heating roller 42B is formed as a cavity, and a heat source (for example, a halogen lamp or the like) 42F is accommodated in an inner section thereof. Accordingly, the heating roller 42B is heated its surface by heat generation of the heat source 42F. In this case, in the present exemplary embodiment, the halogen lamp is used as one example of the heating section. However, it is possible to utilize other heat sources such as a heat source utilizing an induction heating (IH) and the like. Further, in the present exemplary embodiment, the heating roller 42B and the pressurizing roller 42C are utilized as one example of a pair of rotating bodies. However, it is possible to utilize an endless belt transporting out pressurization together with the heating roll, and any structure may be employed as far as it can rotate the paper so as to twine there around and fixed.

Further, a temperature sensor 126 detecting a surface temperature of the heating roller 42B is arranged (in a radial direction) around the heating roller 42B, and at a position which is parted at a predetermined distance.

The temperature sensor 126 has a detection surface opposing to the surface of the heating roller 42B, and is configured to detect a heat radiation (a radiation heat and a convection heat) from the heating roller 42B.

The temperature sensor 126 is configured to detect an infrared emission caused by the heat, and measure a surface temperature of an object.

The temperature sensor 126 detects the surface temperature of at least one of the heating roller 42B and the pressurizing roller 42C in a non-contact manner. The temperature sensor 126 is connected to a temperature management control section 128 for managing the temperature of the fixing section 42, in the fixing control section 122.

The temperature management control section 128 controls to maintain the temperature (the surface temperature) of the heating roller 42B of the fixing section 42 at a predetermined temperature, by a instruction from the main image formation control section 102 of the image processing apparatus 10.

The fixing section 42 is temperature controlled at predetermined temperatures which are different per modes, where the modes are: a pause mode in which the process is not executed for a long time; an image formation mode in which the image forming process is actually executed; and a standby mode in which the mode can give way to the image forming process mode for a comparatively short term. For example, the relations of the temperatures are: pause mode<temperature of standby mode<temperature of image forming process mode.

Further, in the standby mode or the pause mode, the heating roller 42B and the pressurizing roller 42C are separated (not in contact), and the heating roller 42B and the pressurizing roller 42C are brought into contact in the image forming process mode.

If the image forming instruction is given at a time of the standby mode, in which the heating roller 42B of the fixing section 42 is controlled at the predetermined temperature so as to be separated from the heating roller 42C, the temperature management control section 128 controls to make the heating roller 42B and the pressurizing roller 42C in a contact state before the recording paper 30 reaches the fixing section 42, and restore the temperature of the heating roller 42B absorbed by the contact with the heating roller 42C.

In the fixing section 42, in the image forming process mode, the recording paper 30 is sent from the lower side of FIG. 2 from the transfer section 26, and is sandwiched between the heating roller 42B and the pressurizing roller 42C.

At this time, the heating roller 42B is controlled to an optimum temperature for fixing, by the temperature control of the temperature management control section 128. The sandwiched recording paper 30 is carried to the upper side of FIG. 2 while being heated and pressurized.

In this case, at a time of a normal transport, the recording paper 30 passes through the contact point between the heating roller 42B and the pressurizing roller 42C, and is carried linearly in the tangential direction of the heating roller 42B and the pressurizing roller 42C.

On the other hand, there is a case where the recording paper 30 is not normally carried out, and is changed its transport direction while twine around the heating roller 42B (an abnormal transport). Particularly, the twine tends to be generated in the heating roller 42B corresponding to a side in where the toner is transferred. If the abnormal transport is generated, the function of the fixing section 42 stops, and the image forming process itself can not be achieved.

In this case, in the first exemplary embodiment, in order to monitor the abnormal transport (a twine) of the recording paper 30, a twine monitoring control section 130 of the fixing control section 128 determines the abnormal transport form the detected temperature data by the temperature sensor 126. The twine monitoring control section 130 serves as the twine generation determining section, and determines whether or not the recording paper twine around any one of the heating roller 42B and the pressurizing roller 42C, in correspondence to the rate of the temperature increase after the temperature decrease of the surface temperature detected in the non-contact state by the temperature sensor 126.

The abnormal transport is monitored by using the existing temperature sensor 126 without adding any new sensor for monitoring.

(Control System of Fixing Section)

Figure 4:
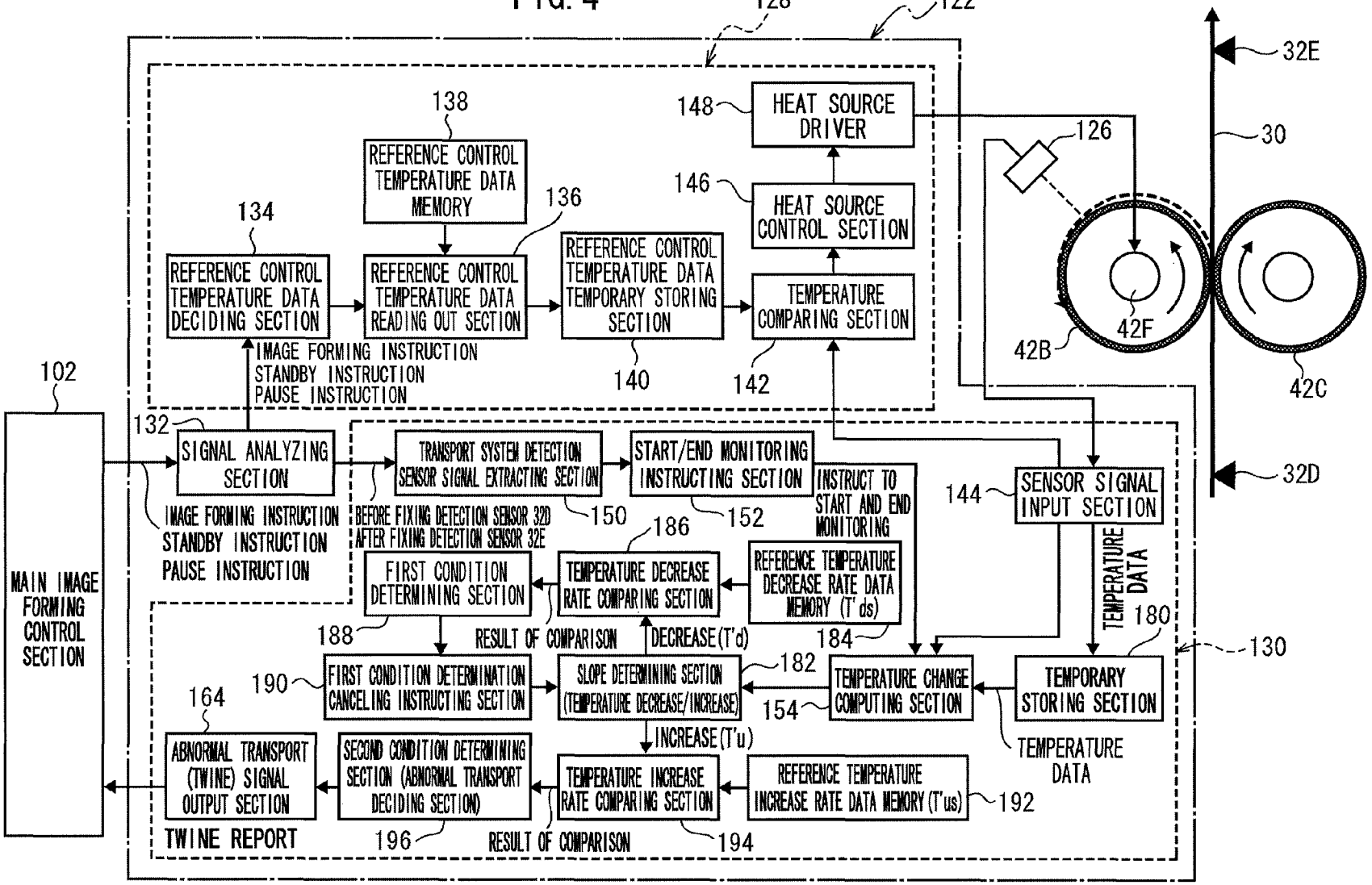
FIG. 4 is a functional block diagram for executing a temperature control, a twine monitoring control and a twine monitoring time management control in a fixing control section in accordance with the first exemplary embodiment.

FIG. 4 shows a functional block diagram of the temperature control in the temperature management control section 128 and the abnormal transport monitoring control in the twine monitoring control section 130, in the fixing control section 122. The functional block diagram of FIG. 4 does not limit the respective hard structures of the temperature management control section 128 and the twine monitoring control section 130, but classifies per functions.

(Temperature Management Control Section 128)

Various signals are output to a signal analyzing section 132 from the main image formation control section 102. The signal analyzing section 132 analyzes these signals, and appropriately outputs the signal.

In the case where the mode change instruction, such as the image forming instruction, the standby instruction, the pause instruction or the like has been instructed to the signal analyzing section 132, these signals are output to a reference control temperature data deciding section 134.

The reference control temperature data deciding section 134 is connected to a reference control temperature data reading out section 136. If the decided reference control temperature data information is input from the reference control temperature data deciding section 134, the reference control temperature data which is suitable for each of the modes is read out from the reference control temperature data memory 138 by the reference control temperature data reading out section 136.

Then the read out reference control temperature data is delivered to a reference control temperature data temporary memory section 140, and is stored in the reference control temperature data temporary memory section 140 temporarily (during maintenance of the mode).

The reference control temperature data temporary memory section 140 is connected to a temperature comparing section 142.

The temperature comparing section 142 is connected to a sensor signal input section 144. The sensor signal input section 144 receives a detection signal from the temperature sensor 126. Further, the detection signal from the temperature sensor 126 is delivered to the temperature comparing section 142 via the sensor signal input section 144 (for example, while being applied an A/D conversion or the like).

If the detection temperature data is input from the sensor signal input section 144, the temperature comparing section 142 reads out the reference control temperature data from the reference control temperature data temporary memory section 140, and compares the two.

A result of comparison in the temperature comparing section 142 is delivered to a heat source control section 146. The heat source control section 146 controls a heat source driver 148 to control a heating state of the heat source 42F based on the result of the temperature comparison. In the case where the heat source 42F is constituted as a halogen lamp, an on and off control of an electric power, or a PID control or the like is executed. Further, if the plural halogen lamps are provided as the heat source 42F, it may be controlled independently.

(Twine Monitoring Control Section 130)

The signal analyzing section 132 connected to the main image forming control section 102 is connected to a transport system detecting sensor signal extracting section 150.

The signal from the before fixing detection sensor 32D and the signal from the after fixing detection sensor 32E are input to the transport system detecting sensor signal extracting section 150.

The before fixing detection sensor 32D detects the leading end of the recording paper 30 at the upstream side of the fixing section 42 as mentioned above. Monitoring of abnormal transport begins from the time at which the before fixing detection sensor 32D detects the leading end of the recording paper 30.

The after fixing detection sensor 32E detects the leading end of the recording paper 30 at the down stream side of the fixing section 42, as mentioned above. Monitoring of abnormal transport ends at the time at which the after fixing detection sensor 32E detects the leading end of the recording paper 30. In other words, if the leading end of the recording paper 30 is detected by the after fixing detection sensor 32E, a predetermined time after the leading end of the recording paper 30 is detected by the before fixing detection sensor 32D, it is possible to determine that the recording paper has been normally transported out (has passed through the fixing section 42).

The transport system detecting sensor signal extracting section 150 is connected to a start/end monitoring instructing section 152, and delivers a instruction for starting or ending a computation to a temperature change computing section 154 based on an input signal source (the before fixing detection sensor 32D or the after fixing detection sensor 32E). The start of computation corresponds to a start of monitoring the abnormal transport, and the end of computation corresponds to an end of monitoring the abnormal transport.

In the case where the signal is input from the before fixing detection sensor 32D, the fixing section 42 executes to bring the heating roller 42B and the pressurizing roller 42C which are separated, into contact. Accordingly, the surface temperature of the heating roller 42B is absorbed by the pressurizing roller 42C. As a result, the surface temperature of the heating roller 42B is lowered.

Figure 5A:
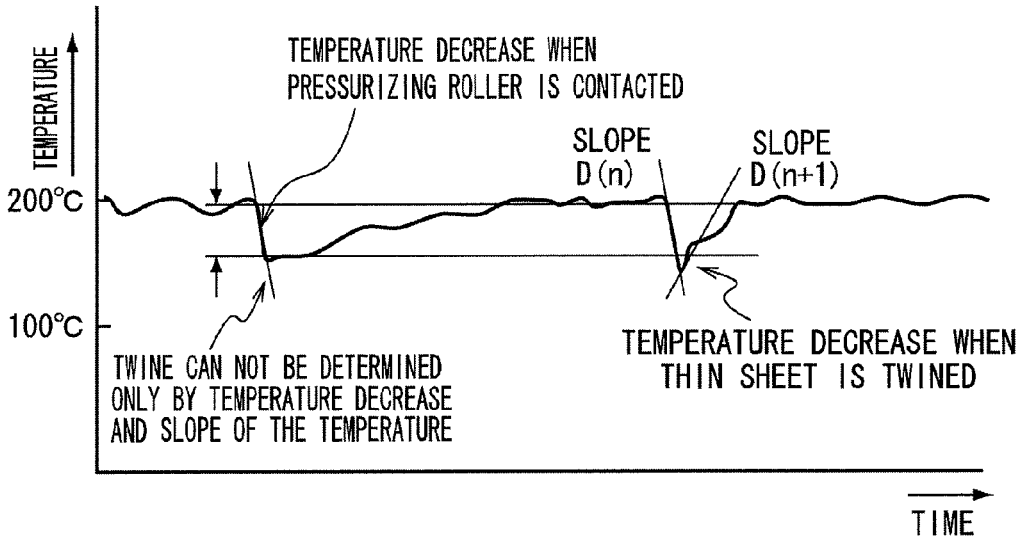
FIG. 5A and FIG. 5B are timing charts showing a temperature transition of a heating roller in accordance with the first exemplary embodiment.

In other words, just after the contact between the heating roller 42B and the pressurizing roller 42C, there may be generated the same phenomenon where the twine of the recording paper 30 has generated in the heating roller 42B (refer to FIG. 5A).

Figure 5B:
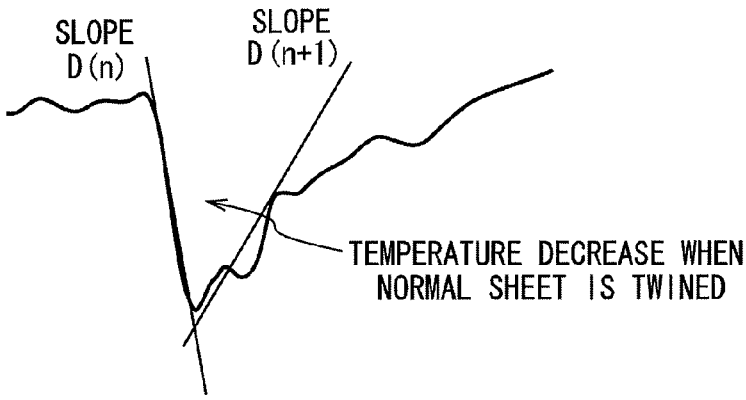

In the first exemplary embodiment, the temperature decrease caused by the contact between the heating roller 42B and the pressurizing roller 42C has the same tendency as the temperature decrease caused by the twine of the recording paper 30, and these temperature decreases are determined as a first condition. After the first condition is established, the temperature decrease is discriminated whether it is caused by the contact between the heating roller 42B and the pressurizing roller 42C or it is caused by the twine of the recording paper 30, based on a temperature increase rate in which the temperature of the heating roller 42B is recovered, as shown in FIG. 5B (a second condition determination).

As shown in FIG. 4, the temperature data from the temperature sensor 126 input to the sensor signal input section 144 is stored in a temporary storage section 180. Further, the sensor signal input section 144 is connected to a temperature change computing section 154. The sensor signal input section 144 outputs a computation start instruction signal to the temperature change computing section 154 every time when the temperature data is input. The temperature change computing section 154 incorporates the temperature data from the temporary storage section 180 based on the input of the computation start instruction signal, and computes an absolute value of the temperature rate (an absolute value |T'd| of a rate or an absolute value |T'u| of a rate mentioned below).

The temperature change computing section 154 is connected to a slope determining section 182, and the temperature change computing section 154 outputs the temperature rate data to the slope determining section 182. The slope determining section 182 determines a slope (decreasingly sloping or increasingly sloping) of the surface temperature of the heating roller 42B, based on the input of the temperature rate data.

In the case that the slope determining section 182 determines the slope of the surface temperature is the decreasingly sloping, the absolute value (|T'd|) of the change rage of the surface temperature is delivered to a temperature decrease rate comparing section 186.

On the other hand, when the slope determining section 182 determines that the slope of the surface temperature is the increasingly sloping, the absolute value (|T'u|) of the rate of the surface temperature is delivered to a temperature increase rate comparing section 194.

A reference temperature decrease rate data memory 184 is connected to the temperature decrease rate comparing section 186. The temperature decrease rate comparing section 186 reads an absolute value |T'ds| of the reference temperature decrease rate from the reference temperature decrease rate data memory 184, based on the input of the absolute value (|T'd|) of the rate of the surface temperature from the slope determining section 182. The temperature decrease rate comparing section 186 compares the absolute value (|T'd|) of the input surface temperature rate with the absolute value |T'ds| of the reference temperature decrease rate.

The temperature decrease rate comparing section 186 is connected to a first condition determining section 188, and outputs a result of comparison to the first condition determining section 188.

The first condition determining section 188 determines that the first condition is established when the absolute value (|T'd|) of the rate of the surface temperature is larger than the absolute value |T'ds| of the reference temperature decrease rate. The first condition recognizes a generation of any one of the temperature decrease caused by the contact between the heating roller 42B and the pressurizing roller 42C, and the temperature decrease caused by the twine of the recording paper 30.

In the present exemplary embodiment, as the first condition determination, success and failure are determined based on the rate of the temperature decrease of the surface temperature. However, the success and failure of the first condition may be determined based on whether the surface temperature decrease is at a predetermined amount, in addition to the above. Accordingly, it is possible to detect the generation of any one of the temperature decrease caused by the contact between the heating roller 42B and the pressurizing roller 42C, and the temperature decrease caused by the twine of the recording paper 30, by determining whether the surface temperature becomes equal to or lower than a certain threshold value.

The first condition determining section 188 is connected to a first condition determination cancel instruction section 190. The first condition determining section 188 delivers a cancel execution instruction signal to the first condition determination cancel instruction section 190 when the first condition is established. The first condition determination cancel instruction section 190 inhibits an output of the absolute value (|T'd|) of the rate of the surface temperature in the slope determining section 182, based on the input of the cancel execution instruction signal.

Accordingly, the first condition determination during the future temperature decrease is canceled.

On the other hand, in the slope determining section, a reference temperature increase rate data memory 192 is connected to a temperature increase rate comparing section 194 to which the absolute value (|T'u|) of the increasingly sloping rate is input. The temperature increase rate comparing section 194 read an absolute value |T'us| of the reference temperature increase rate from the reference temperature increase rate data memory 192, based on the input of the absolute value (|T'u|) of the rate of the surface temperature from the slope determining section 182. The temperature increase rate comparing section 194 compares the absolute value (|T'u|) of the input surface temperature rate with the absolute value |T'us| of the reference temperature increase rate. As an example of a previously set first reference value, the absolute value |T'us| may be used.

The temperature increase rate comparing section 194 is connected to a second condition determining section 196, and outputs a result of comparison to the second condition determining section 196.

The absolute value |T'us| of the reference temperature increase rate stored in the reference temperature increase rate data memory 192 is set between an absolute value of the temperature increase rate after when the heating roller 42B and the pressurizing roller 42C mutually contacts, and an absolute value of the temperature increase rate after when the recording paper 30 is twined.

Accordingly, the second condition determining section 196 determines whether the temperature restoration is caused by the contact of the heating roller 42B and the pressurizing roller 42C, or the temperature restoration is caused by the twine of the recording paper 30, based on the result of comparison between the absolute value |T'u| of the rate of the surface temperature and the absolute value |T'us| of the reference temperature increase rate. Therefore, the abnormal transport of the recording paper 30, that is, the twine around the heating roller 42B is detected (generation of an abnormal decision signal).

The second condition determining section 196 is connected to an abnormal transport (twine) signal output section 164. The abnormal transport (twine) signal output section 164 delivers a twine failure informing signal to the main image forming control section 102 based on the input of the abnormal decision signal from the second condition determining section 196.

The main image forming control section 102 executes an abnormal information by using the GUI 124, or executes a correspondence stopping the function (the image formation, the transport or the like), based on the abnormal signal from the twine monitoring control section 130 of the fixing section 42.

A description will be given below of an operation of the first exemplary embodiment with reference to flow charts in FIG. 6 and FIG. 7.

Figure 6:
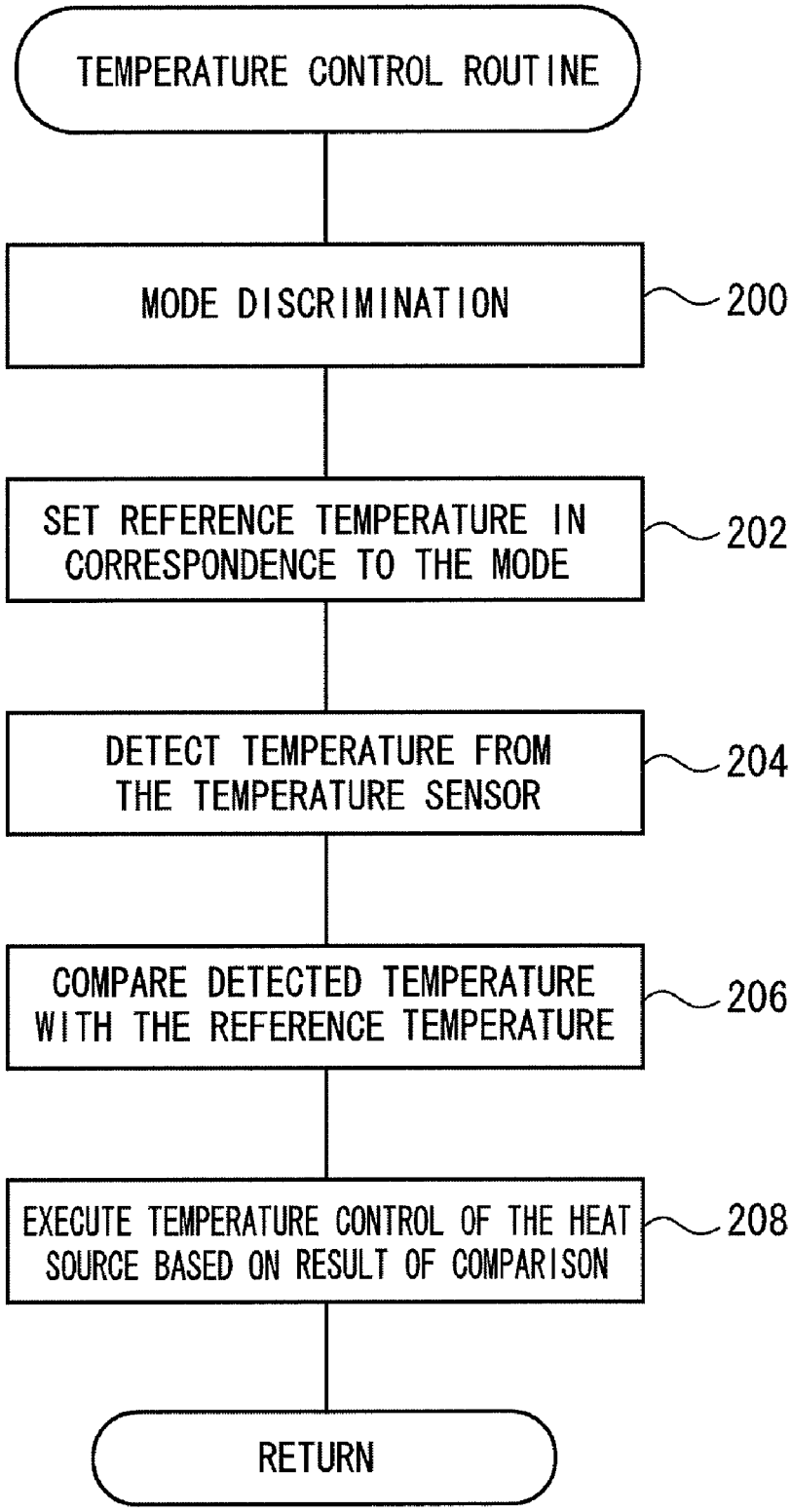
FIG. 6 is a flow chart showing a temperature control routine in the temperature management control section in accordance with the first exemplary embodiment.

FIG. 6 is a flow chart showing a temperature management control routine in the temperature management control section 128 of the fixing control section 122.

At step 200, a mode is discriminated, and at step 202, a corresponding reference temperature to the discriminated mode is set. Further, at step 204, the temperature is detected by the temperature sensor 126, and proceeds to step 206. At the step 206, the detected temperature is compared with the reference temperature, and proceeds to step 208.

At step 208, a temperature control of the heat source 42F of the heating roller 42B is executed based on the result of comparison, and the routine finishes.

Figure 7:
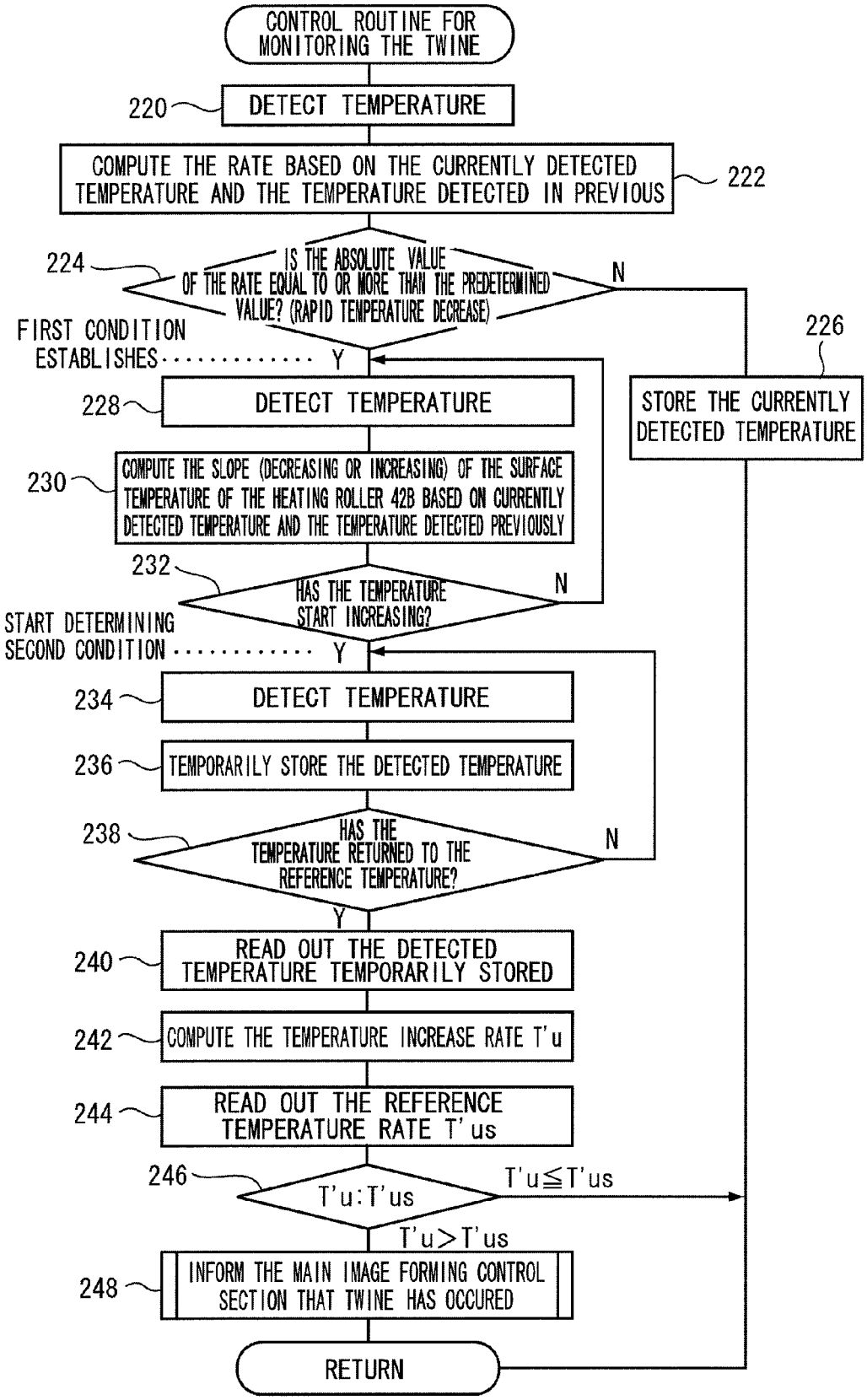
FIG. 7 is a flow chart showing control routine for monitoring a twine in the twine monitoring control section in accordance with the first exemplary embodiment.

FIG. 7 is a flow chart showing a twine monitoring control routine in the twine monitoring control section 130 of the fixing control section 122.

At step 220, the surface temperature of the heating roller 42B is detected by the temperature sensor 126, and proceeds to step 222.

At step 222, an absolute value of the temperature rate is computed based on the currently detected temperature data and the previously detected temperature data.

At next step 224, based on the absolute value of the computed temperature rate, the existence of temperature decrease is determined. If a negative determination (a normal determination) is carried out in step 224, the step proceeds to step 226, and stores the currently detected temperature data, and this routine finishes.

Further, if an affirmative determination (a temperature decrease determination) is carried out in the step 224, the first condition is established, and the step proceeds to step 228.

The first condition establishment means that the recognition of the generation of any one of the temperature decrease may be caused by the contact between the heating roller 42B and the pressurizing roller 42C, or the temperature decrease caused by the twine of the recording paper 30. However, in this case, it is unknown which of them is generated.

In the present exemplary embodiment, as one example of the first condition determination, the success and failure is determined based on the rate of the temperature decrease of the surface temperature. In addition, the success and failure of the first condition establishment may be determined by the amount of the temperature decrease of the surface temperature. In this case, at step 224, whether a predetermined temperature decrease is generated in the surface temperature is determined, and if the step 224 is affirmed, the first condition is established, and the step proceeds to step 228.

In the step 228, to confirm that the temperature decrease carries over for a while after the first condition is established, the temperature is detected again by the temperature sensor 126, to discriminate the time when the temperature increases, based on the determination, and the step proceeds to step 230.

At step 230, a slope (decreasingly sloping or increasingly sloping) of the surface temperature of the heating roller 42B is computed, based on the currently detected temperature data, and the previously detected temperature data.

At next step 232, whether the temperature is increasing, is determined based on the computed result, and if an affirmative determination (the temperature increase) is output, the second condition determination is started, and the step proceeds to a step 234.

The second condition determination determines whether the temperature decrease is caused by the twine of the recording paper 30, among two phenomena, lined up as the candidates when the first condition is established.

At step 234, the temperature is detected by the temperature sensor 126, and the detected temperature data is temporarily stored in step 236.

At next step 238, whether the surface temperature of the heating roller 42B is restored to the reference temperature is determined, and if an affirmative determination is output, the step proceeds to step 240.

At step 240, the temperature data temporarily stored in the step 236 is read out, and the step proceeds to step 242.

At step 242, an absolute value (|T'u|) of the temperature increase rate is computed based on the currently detected temperature data, and the previously detected temperature data. At step 244, a reference temperature rate data (|T'us|) is read out.

At next step 246, the absolute value (|T'u|) of the temperature increase rate is compared with the reference temperature rate data (|T'us|). If the absolute value (|T'u|) of the temperature increase rate is equal to or less than the reference temperature rate data (|T'us|) (|T'u|≦|T'us|), it is determined that the temperature increase is caused by the contact between the heating roller 42B and the pressurizing roller 42C, and this routine finishes.

On the other hand, if the absolute value (|T'u|) of the temperature increase rate is larger than the reference temperature rate data (|T'us|) (|T'u|>|T'us|), it is determined that the temperature increase is caused by the twine of the recording paper 30. Accordingly, the twine of the recording paper 30 around the heating roller 42B can be detected.

At step 248, the main image forming main control section 102 informs that the twine has generated, and this routine finishes.

Further, as the second condition, if the absolute value (|T'u|) of the temperature increase rate is larger than the reference temperature rate data |T'us|, which is one example of the first reference value, the occurrence of the twine can be determined. However, the configuration may be such that a second reference temperature rate data |T'us2| is set as a third reference value which is smaller than the reference temperature rate data |T'us|, and when the absolute value |T'u| of the rate is smaller than the second reference temperature rate data |T'us2|, an abnormal transport, in which the recording paper 30 is closely attached to the sensor surface of the temperature sensor 126, is determined to have been generated.

The unique twine (the close contact abnormal) means a state in which the recording paper 30 is wound around the heating roller 42B, and an end section of the recording paper 30 comes into contact with the temperature sensor 126 which is spaced from the heating roller 42B at a predetermined distance. In this case, since the end section of the recording paper 30 is being away from the heating roller 42B, it takes time to increase the temperature of the end section of the recording paper 30. Further, the temperature sensor 126 detects the temperature of the end section of the recording paper 30. Accordingly, to recognize that it takes time to increase the temperature, if the reference temperature rate data |T'u| is smaller than the second reference temperature rate data |T'us2|, it is determined that the recording paper 30 has twined around the heating roller 42B, even if the reference temperature rate data |T'u| is smaller than the reference temperature rate data |T'us|.

Further, in the first exemplary embodiment, a material, a thickness and the like of the recording paper are not referred. However, if this matter is taken into consideration where the recording paper 30 absorbs the heat from the heating roller 42B, the structure may be made to correct the absolute value (the temperature increase) of the computed rate, or the reference value (the third threshold value) based on the material, the thickness or the like of the recording paper 30.

Specifically, in the ROM 108 and the RAM 106, a correction value for correcting the threshold value per the material of the recording medium 30, or the thickness of the recording medium 30 are stored. The first reference temperature rate data |T'us| or the second reference temperature rate data |T'us2| is corrected by acquiring the correction value by an acquiring section (not shown) and using the correction value corresponding to the material of the recording medium 30 and the thickness of the recording medium 30. In other words, the thicker the recording medium is, or the higher a heat absorption rate is, the increase of temperature becomes dull. Accordingly, it becomes difficult to determine that the recording paper 30 twine when the correction is made. Accordingly, in place of correcting the first reference temperature rate data |T'us| or the second reference temperature rate data |T'us2|, the structure may be made to correct the absolute value (|T'u|) of the temperature increase rate.

A description will be given of an operation of the second condition determination.

When detecting the surface temperature of the heating roller 42B in the non-contact manner by the temperature sensor 126, if the recording paper 30 twine around the heating roller 42B, it means that the recording paper 30 is interposed between the temperature sensor 126 and the heating roller 42B. Accordingly, the temperature sensor 126 temporarily detects the temperature of the recording paper 30 having a lower temperature in comparison with the heating roller 42B.

It can be known that the recording paper 30 twine around the heating roller 42B, by utilizing the temporary temperature decrease.

However, when the thickness of the recording paper 30 is thin, the temperature decrease caused by the twine of the thin recording paper 30 around the heating roller 42B becomes small, which may cause difficulty to differentiate from the temperature decrease of the heating roller 42B caused by the contact between the heating roller 42B and the pressurizing roller 42C.

In other words, when the heating roller 42B and the pressurizing roller 42C are separated, the pressurizing roller 42C will not be heated by the heating roller 42B. Accordingly, the temperature of the pressurizing roller 42C becomes lower when compared with the heating roller 42B. If the heating roller 42B and the pressurizing roller 42C come to the contact state, the pressurizing roller 42C absorbs a heat quantity from the heating roller 42B. Accordingly, the temperature of the heating roller 42B is temporarily lowered.

Therefore, it is possible to differentiate the temperature decrease caused by the twine of the recording paper 30 around the heating roller 42B from the temperature decrease caused by the contact between the heating roller 42B and the pressurizing roller 42C, by transporting out the second condition determination as mentioned above.

In other words, the temperature decrease caused by the twine of the recording paper 30 around the heating roller 42B is affected by the interposition of the recording paper 30 between the temperature sensor 126 and the heating roller 42B, more greatly than the absorption of the heat quantity from the heating roller 42B. The temperature of the recording paper 30 twine around the heating roller 42B immediately increases. On the other hand, the temperature decrease caused by the contact between the heating roller 42B and the pressurizing roller 42C absorbs the heat quantity itself from the heating roller 42B. Accordingly, it takes a longer time to increase the temperature of the heating roller 42B.

The difference of the temperature increase appears in the rate of temperature increase after the temperature decrease. Therefore, it is possible to differentiate the temperature decrease caused by the twine of the recording paper 30 around the heating roller 42B from the temperature decrease caused by the contact between the heating roller 42B and the pressurizing roller 42C, by utilizing this method.

Second Embodiment

A description will be given of a second exemplary embodiment in accordance with the present invention. In the second exemplary embodiment, the same constituting sections as those of the first exemplary embodiment, a description of the structure thereof will be omitted by assigning the same reference numbers.

In the first exemplary embodiment, the twine is determined substantially only by the absolute value of the rate of the temperature increase (the restoring time). On the other hand, the second exemplary embodiment determines whether the recording medium twine around any one of a pair of rotating bodies in correspondence to the rate of the temperature decrease of the surface temperature, and the rate of the temperature increase of the surface temperature after the temperature decrease of the surface temperature.

Figure 8A:
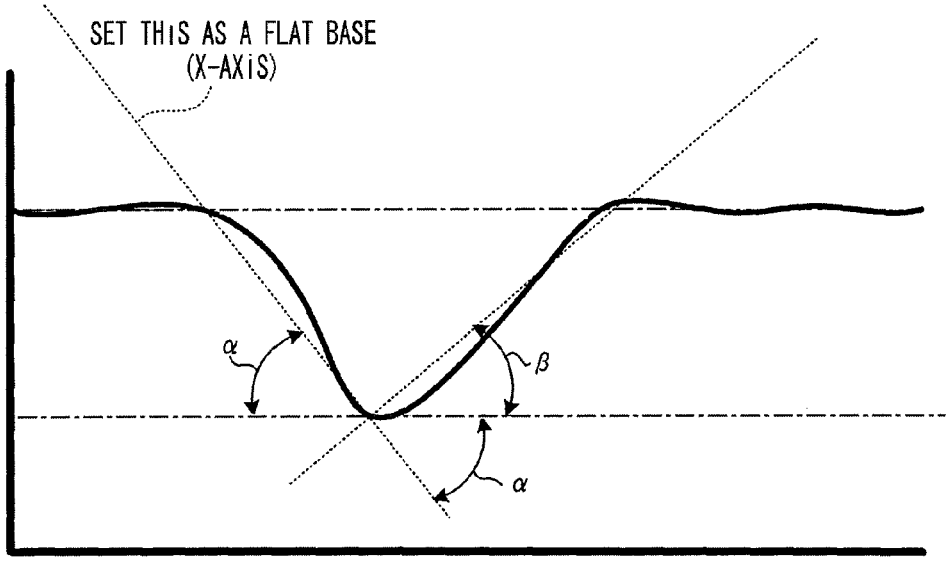
FIG. 8A and FIG. 8B are timing charts showing a temperature transition of a heating roller in accordance with a second exemplary embodiment.

FIG. 8A shows a transition of the temperature change of the surface temperature of the heating roller 42B. The temperature change has a tendency that the surface temperature of the heating roller 42B at the reference temperature temporarily decreases due to some cause, and thereafter returns to the reference temperature. In other words, any one of, the contact between the heating roller 42B and the pressurizing roller 42C (the first cause), or the twine of the recording paper 30 around the heating roller 42B (the second cause) have caused, as described in the first exemplary embodiment.

In this case, the second exemplary embodiment temporarily accumulates and stores all the data from the temperature decrease start to the temperature restoration end, and computes the rate at a time of increase of the temperature by setting a slope at a time of the temperature decrease to a flat base (an x-axis). Based on the result of computation, the twine is determined by discriminating whether the first cause or the second cause.

As shown in FIG. 8A, at a time of the temperature decrease, a rate T'd is obtained based on the temperature data detected from the temperature sensor 126, and an angle α is obtained in accordance with the following expression (1) based on the rate.

$$\tan^{-1}(|T'd|)=\alpha \quad (1)$$

On the other hand, as shown in FIG. 8A, at a time of the temperature increase, a rate T'u is obtained based on the temperature data detected from the temperature sensor 126, and an angle β is obtained in accordance with the following expression (2) based on the rate.

$$\tan^{-1}(|T'u|)=\beta \quad (2)$$

Figure 8B:
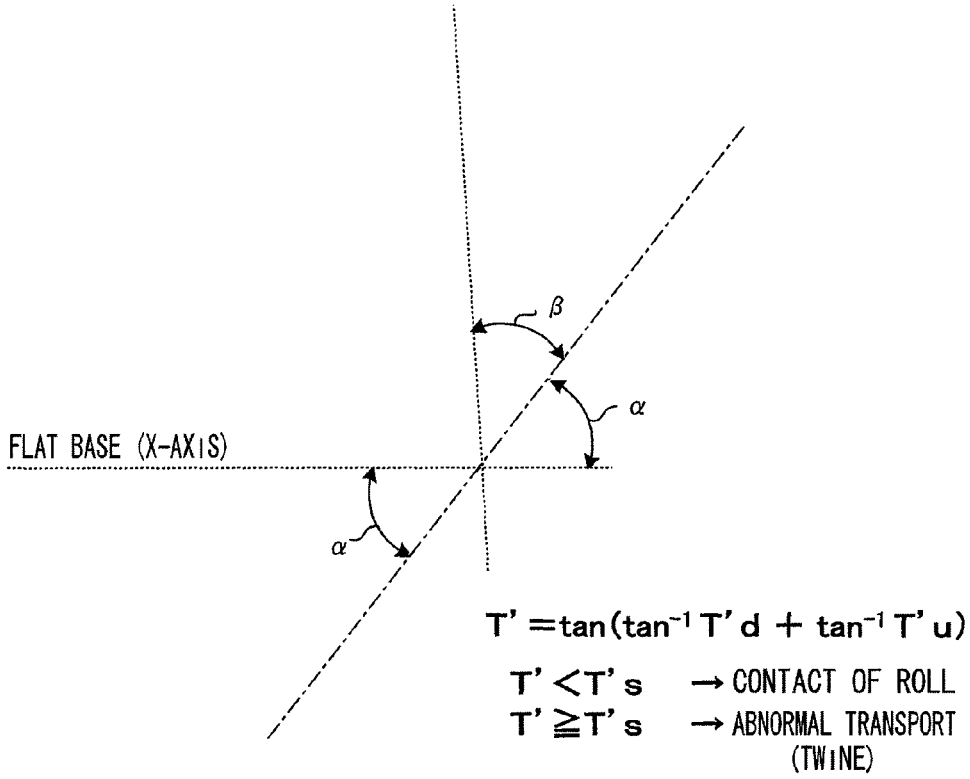

FIG. 8B is a drawing in which a slope at a time of the temperature decrease in FIG. 8A is set as x-axis. In accordance with this FIG. 8B, a rate T' at a time of the temperature increase based on the slope at a time of the temperature decrease can be determined, in accordance with the following expression (3).

$$T'=\tan(\alpha+\beta) \quad (3)$$

In accordance with the expressions (1) and (2), the expression (3) can be expressed by the following expression (4).

$$T'=\tan(\tan^{-1}|T'd|+\tan^{-1}|T'u|) \quad (4)$$

In the second exemplary embodiment, a twine determination reference rate T's comparing with the rate T' which is previously stored. When an absolute value of the rate computed by the expression (4) is equal to or more than the determination reference rate (T'≧T's), the generation of twine is determined, and when it is less than the determination reference rate (T'<T's) it is determined that the twine has not generated. As one example of the second reference value, the determination reference rate T's is used.

In the case when a value obtained by adding the rate of the temperature increase of the surface temperature to the rate of the temperature decrease of the surface temperature is equal to or more than the previously set second reference value, it is determined that the recording paper 30 has twine around any one of the heating roller 42B or the pressurizing roller 42C.

A description will be given below of an operation of the second exemplary embodiment in accordance with a flow chart in FIG. 9.

At step 260, the surface temperature of the heating roller 42B is detected by the temperature sensor 126, and proceeds to step 262.

At step 262, determines whether the currently detected temperature data has a temperature decrease equal to or more than a predetermined level in comparison with the previously detected temperature data. If a negative determination is output in step 262 (the temperature decrease equal to or more than the predetermined level is not generated), the routine finishes.

On the other hand, if an affirmative determination is output in step 262 (the temperature decrease equal to or more than the predetermined level is generated), the step proceeds to step 264. At step 264, the detected temperature data is temporarily stored in a memory Md. Accordingly, the temperature data is accumulated in the memory Md.

At step 266, it is determined whether the surface temperature of the heating roller 42B, which has exhibited a decreasing tendency, has begun to exhibit a restoring tendency. In this case, if a negative determination is output (the decreasing tendency is determined), the step proceeds to step 268. At step 268, the temperature detection of the surface of the heating roller 42B carries on. Then the step returns to step 264, and the step mentioned above is repeated.

On the other hand, if an affirmative determination is output (the restoring tendency is determined) in step 266, the step proceeds to step 270. AT step 270, the rate T'd of the surface temperature is computed based on the plural temperature data of the heating roller 42B stored in the memory Md. In the first exemplary embodiment, the success and failure of the establishing of the first condition is determined based on the rate of the temperature decrease. However, in the second exemplary embodiment, it is not necessary to determine by the rate of the temperature decrease.

At step 266, the surface temperature of the heating roller 42B is identified as the restoring tendency. Accordingly, at step 272, the detected temperature data is temporarily stored in a memory Mu. Therefore, the temperature data is accumulated in the memory Mu.

At next step 274, whether the surface temperature of the heating roller 42B, having the increasing tendency, is restored to the temperature of a standard control temperature is determined. If a negative determination is output (when it is determined that it does not reach the standard control temperature), the step proceeds to step 276. At step 276, the temperature detection of the surface of the heating roller 42B is carried on. Then the step returns to the step 272, and the step mentioned above is repeated.

On the other hand, an affirmative determination is output (it is determined that it reaches the standard control temperature) in the step 274, the step proceeds to step 278. At step 278, the rate T'u of the surface temperature based on the temperature data of the heating roller 42B is computed and stored in the memory Mu.

At step 280, a rate T' of the surface temperature of the heating roller 42B based on T'd and T'u is computed, and proceeds to step 282. Since the rate T' is based on a slope of the temperature decrease, a numerical value may include a correlation between the rate of temperature decrease and the rate of temperature increase.

At step 282, the twine determination reference rate T's is read out, and proceeds to step 284.

At next step 284, the rate (T') of the surface temperature and the rate (T's) of the twine determination reference are compared. If the rate (T') of the surface temperature is less than the rate (T's) of the twine determination reference (T'<T's), it means that the generated temperature increase is by the contact between the heating roller 42B and the pressurizing roller 42C. Accordingly, it is determined that the twine of the recording paper 30 is not generated, and the step proceeds to step 288.

On the other hand, if the rate (T') of the surface temperature is equal to or more than the twine determination reference rate (T's) (T'≧T's) in step 284, it is determined that the generated temperature increase is by the twine of the recording paper 30. In other words, the twine of the recording paper 30 around the heating roller 42B is decided.

At step 286, a twine around the heating roller 42B abnormal process is carried out, and then the step proceeds to the step 288. The twine process in the step 286 informs that the twine has occurred, to the main image forming control section 102.

At next step 288, the memory Md and the memory Mu which temporarily accumulate and store the detection temperature are cleared, and this routine finishes.

In the second exemplary embodiment, the twine is determined based on the rate T' corresponding to the numerical value including the correlation between the rate of the temperature decrease and the rate of the temperature increase, by setting the slope of the temperature decrease as a base. However, it is possible to simply compare a value obtained by addition, subtraction, multiplication and division of the rate T'd of the temperature decrease and the rate T'u of the temperature increase with a previously set reference value T's1. For example, T'u−T'd may be compared with the reference value T's1. Further, it is possible to compare by setting an angle based on the slope of the temperature decrease, or is possible to compare separately in the temperature decrease and the temperature increase.

Further, in the first exemplary embodiment and the second exemplary embodiment, it is determined whether the recording paper 30 twines around the heating roller 42B. However, it is possible to forecast that the recording paper 30 may twine around the pressurizing roller 42C unwontedly, and is possible to arrange a temperature sensor 126A corresponding to the pressurizing roller 42C, as shown in FIG. 2.

Third Embodiment

A third exemplary embodiment detects the abnormal transport based on the detected temperature data, detected by the temperature sensor 126, in order to monitor the abnormal transport (the twine) of the recording paper 30, in the twine monitoring control section 130 of the fixing control section 128. The twine monitoring control section 130 is used as one example of the twine generation determining section, and determines whether the recording paper has twined around any one of the heating roller 42B or the pressurizing roller 42C, in correspondence to the temperature decrease of the surface temperature contactlessly detected by the temperature sensor 126.

(Control System of Fixing Section)

Figure 10:
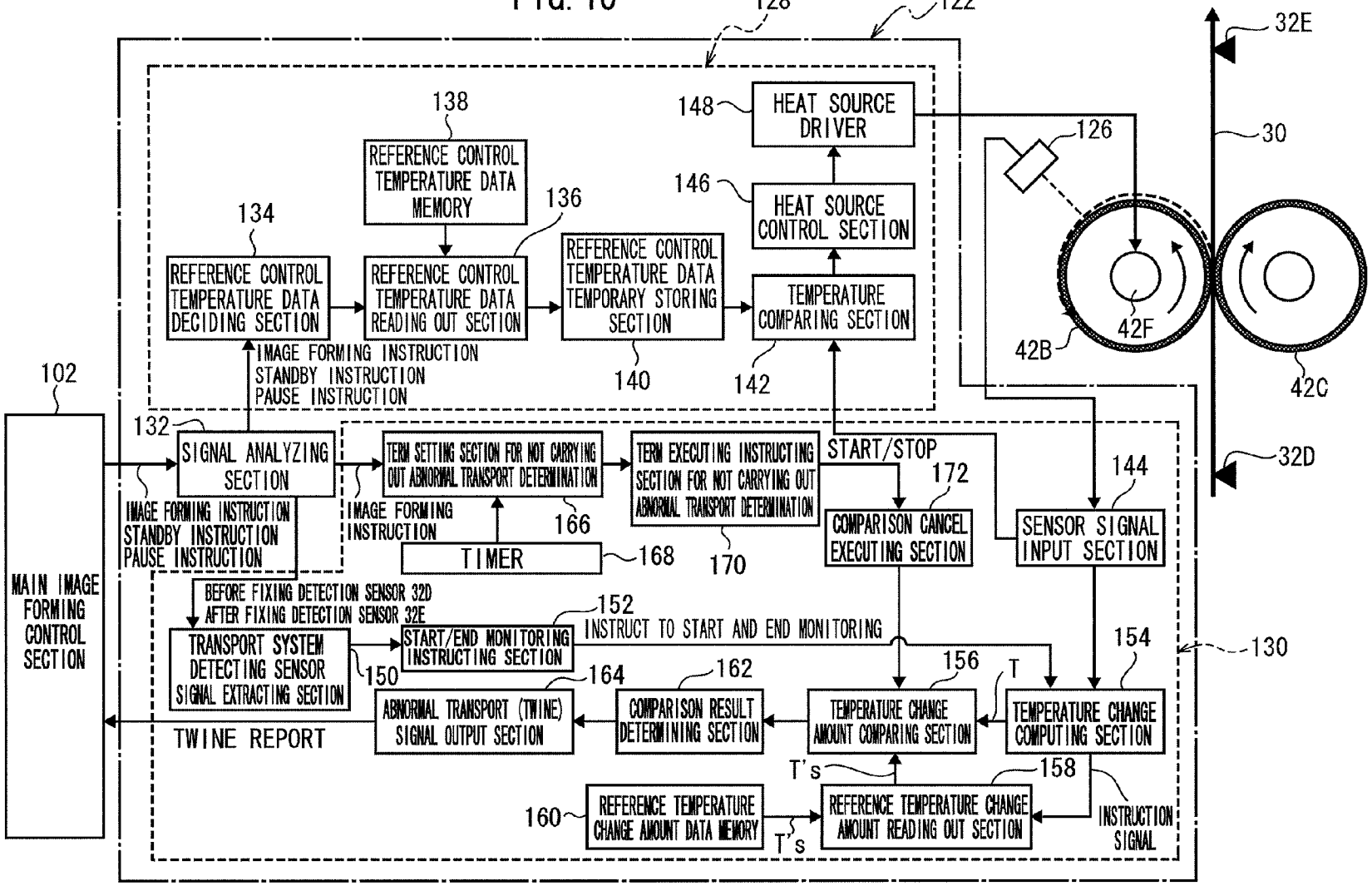
FIG. 10 is a functional block diagram for executing a temperature control, a twine monitoring control and a twine monitoring time management control in a fixing control section in accordance with a third exemplary embodiment.

FIG. 10 illustrates a functional block diagram of the temperature control in the temperature management control section 128 and the abnormal transport monitoring control in the twine monitoring control section 130, in the fixing control section 122. In this case, with regard to the same constituting sections as those of the first exemplary embodiment, a description of the structure will be omitted by assigning the same reference numbers.

The transport system detecting sensor signal extracting section 150 is connected to the start/end monitoring instruction section 152. The transport system detecting sensor signal extracting section 150 delivers an instruction for starting or ending a computation to the temperature change computing section 154 based on an input signal source (the before fixing detection sensor 32D or the after fixing detection sensor 32E). The start of computation corresponds to a start of monitoring the abnormal transport, and the end of computation corresponds to an end of monitoring the abnormal transport.

The temperature change amount computing section 154 is connected to the sensor signal input section 144. In the temperature change amount computing section 154, the temperature data detected by the temperature sensor 126 is input during power up (during the abnormal transport monitoring term), and the absolute value of the temperature change amount is computed based on the temperature data between two points of at least different time.

The temperature change amount computing section 154 is connected to a temperature change amount comparing section 156, and a reference temperature change amount reading out section 158. A temperature change amount data corresponding to a result of computation is delivered to the temperature change amount comparing section 156 from the temperature change amount computing section 154. An instruction signal is delivered to the reference temperature change amount reading section 158 from the temperature change amount computing section 154 in synchronization with the result of the computation from the temperature change amount computing section 154.

The reference temperature change amount reading section 158 reads an absolute value of the reference temperature change amount from a reference temperature change amount data memory 160 based on the input of the instruction signal, and delivers to the temperature change amount comparing section 156.

An absolute value |T'| of an actually computed temperature change amount and an absolute value |T's| of a reference temperature change amount are input to the temperature change amount comparing section 156, and both values are compared. In this case, the absolute value |T's| of the reference temperature change amount is used as one example of the previously set reference value.

A result of comparison in the temperature change amount comparing section 156 is delivered to a comparison result determining section 162. The comparison result determining section 162 determines that the recording paper 30 has twined around the heating roller 42*b*, in the case that the absolute value |T'| of the temperature change amount gets over the absolute value |T's| of the reference temperature change amount. Then, the comparison result determining section 162 delivers the result of determination to the abnormal transport signal output section 164. Accordingly, the abnormal transport signal output section 164 outputs the abnormal transport signal (the twine) to the image forming control section 102.

The image forming control section 102 executes the abnormal transport information by using the GUI 124, or executes stopping the function (the image formation, the transport and the like), based on the abnormal transport signal from the twine monitoring control section 130 of the fixing section 42.

When the signal from the before fixing detection sensor 32D is input, the fixing section 42 executes to bring the heating roller 42B and the pressurizing roller 42C mutually separated, into contact with each other. Accordingly, the surface temperature of the heating roller 42B is absorbed by the pressurizing roller 42C. As a result, the surface temperature of the heating roller 42B is rapidly lowered (comes to the absolute value of the great temperature change amount).

In other words, just after the contact between the heating roller 42B and the pressurizing roller 42C, there may be generated the same phenomenon with the twine failure of the recording paper 30 is generated in the heating roller 42B.

Figure 11:
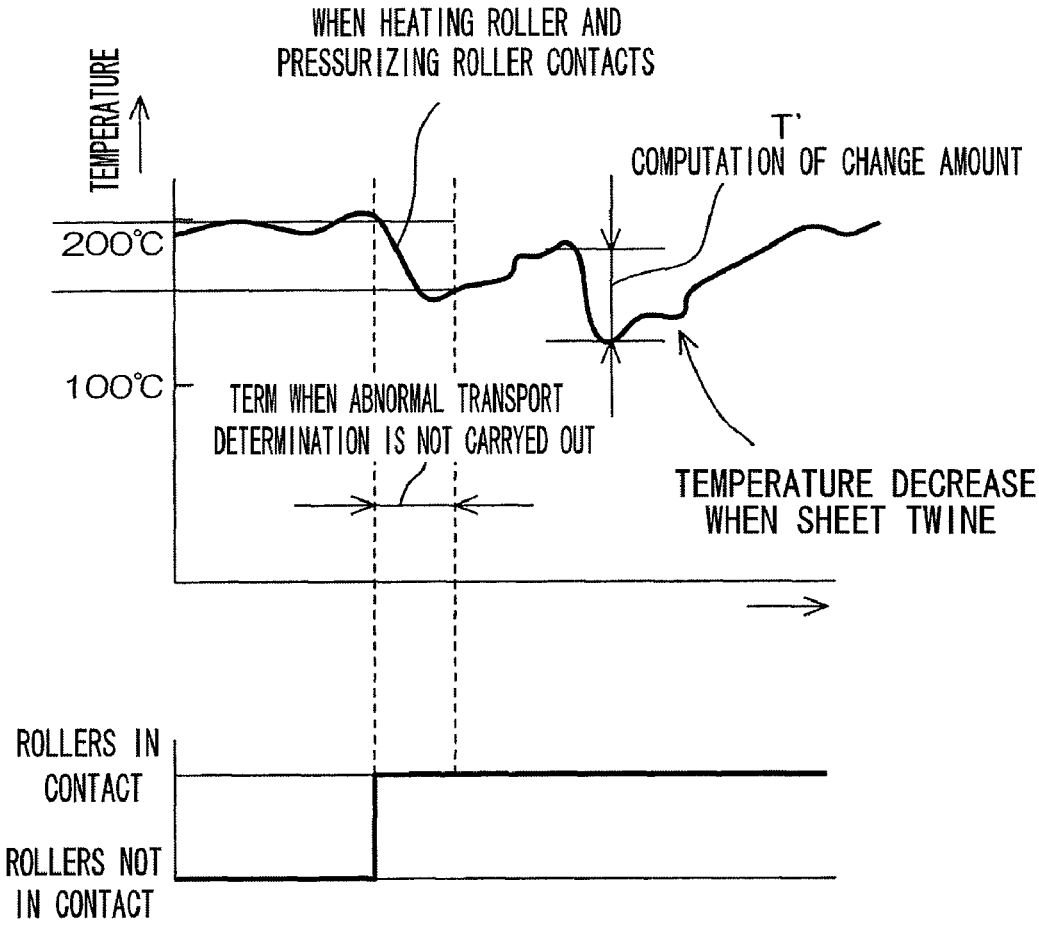
FIG. 11 is a timing chart for a temperature control and a twine start control in accordance with the third exemplary embodiment.

In the third exemplary embodiment, the abnormal transport determination is not carried out (refer to FIG. 11) for a predetermined term (hereinafter, refer to as "initial term") just after the contact of the heating roller 42B and the pressurizing roller 42C.

The undetected term may be set by the start time of the contact movement for contacting the heating roller 42B and the pressurizing roller 42C, based on the image forming process instruction.

As shown in FIG. 10, the signal analyzing section 132 is connected to a term setting section 166, the term to carry out the abnormal transport determination. When the image forming instruction is input to the signal analyzing section 132, the image forming instruction signal is delivered to the term setting section 166.

The term not to carry out the abnormal transport determination is determined as the start time of the initial term based on this signal, and a delivery of the initial term signal is started to an execution instruction section for not carrying out abnormal transport determination 170 by using a timer 168 (a start signal). Thereafter, the delivery is finished at the end of the initial term, by clocking the timer 168 (a stop signal).

The execution instruction section 170 delivers the start signal and the stop signal to a comparing cancel executing section 172 at a time of the start and the end of the initial term signal. The comparing cancel executing section 172 delivers the cancel signal to the temperature change amount comparing section 156 during the term from the start signal to the stop signal. As a result, the comparing process in the temperature change amount comparing section 156 is canceled. Further, the third exemplary embodiment is configured not to carry out the abnormal transport determination by the temperature change amount comparing section 15. However, the configuration is not limited to this, but can be made to carry out the abnormal transport determination, however, not to output the twine generation signal to the main image forming control section 102 based on the result of determination.

A description will be given of an operation of the third exemplary embodiment in accordance with a flow chart in FIG. 12 to FIG. 14.

Figure 12:
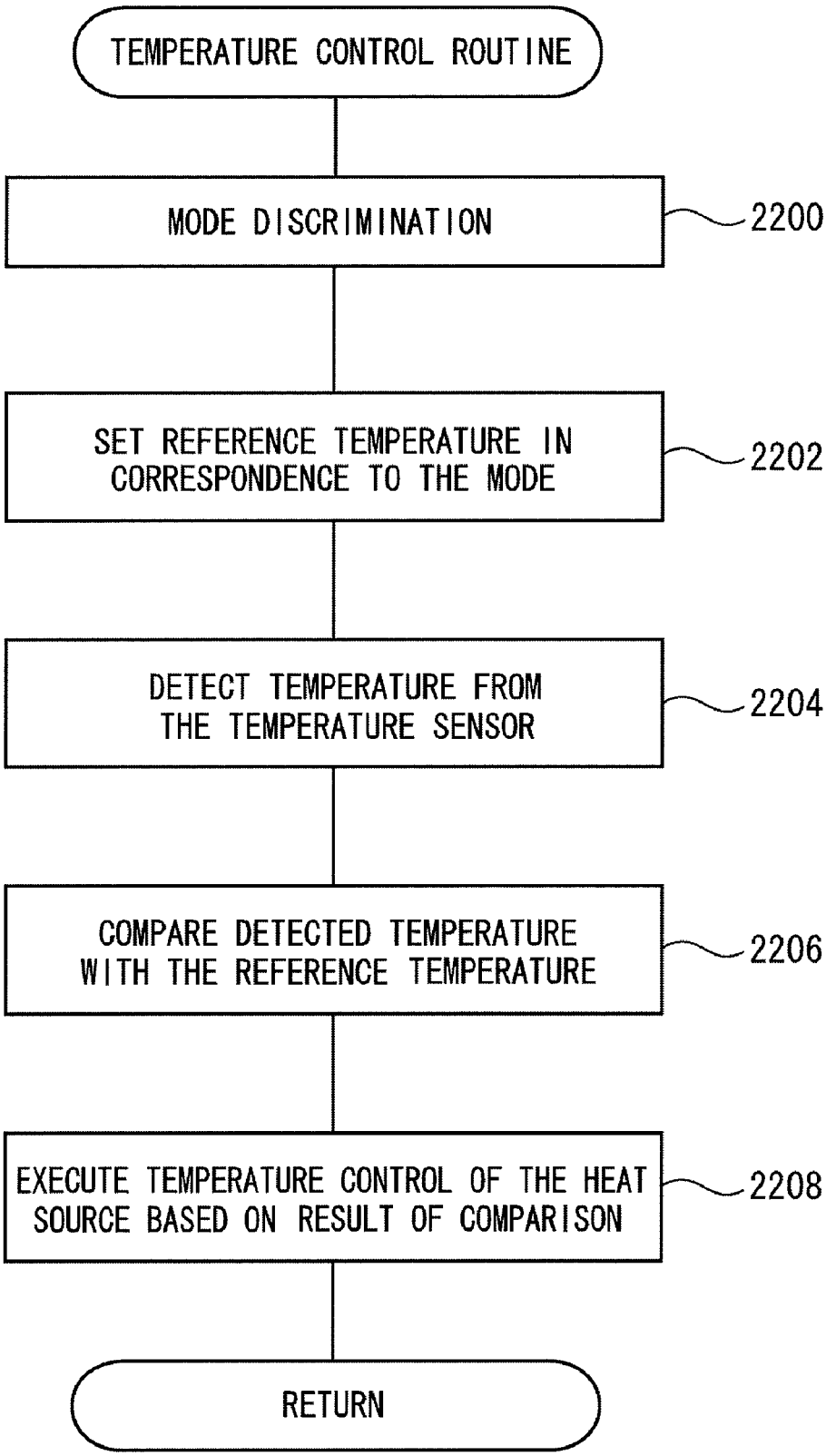
FIG. 12 is a flow chart showing a temperature control routine in the temperature management control section in accordance with the third exemplary embodiment.

FIG. 12 is a flow chart showing a temperature management control routine in the temperature management control section 128 of the fixing control section 122.

At step 2200, a mode is discriminated, and at next step 2202, reference temperature corresponding to the discriminated mode is set. At step 2204, the temperature is detected by the temperature sensor, then the step proceeds to step 2206 to compare the detected temperature with the reference temperature. Then the routine proceeds to step 2208.

At step 2208 temperature control of the heat source 42F of the heating roller 42B is executed, based on the result of comparison, and this routine finishes.

Figure 13:
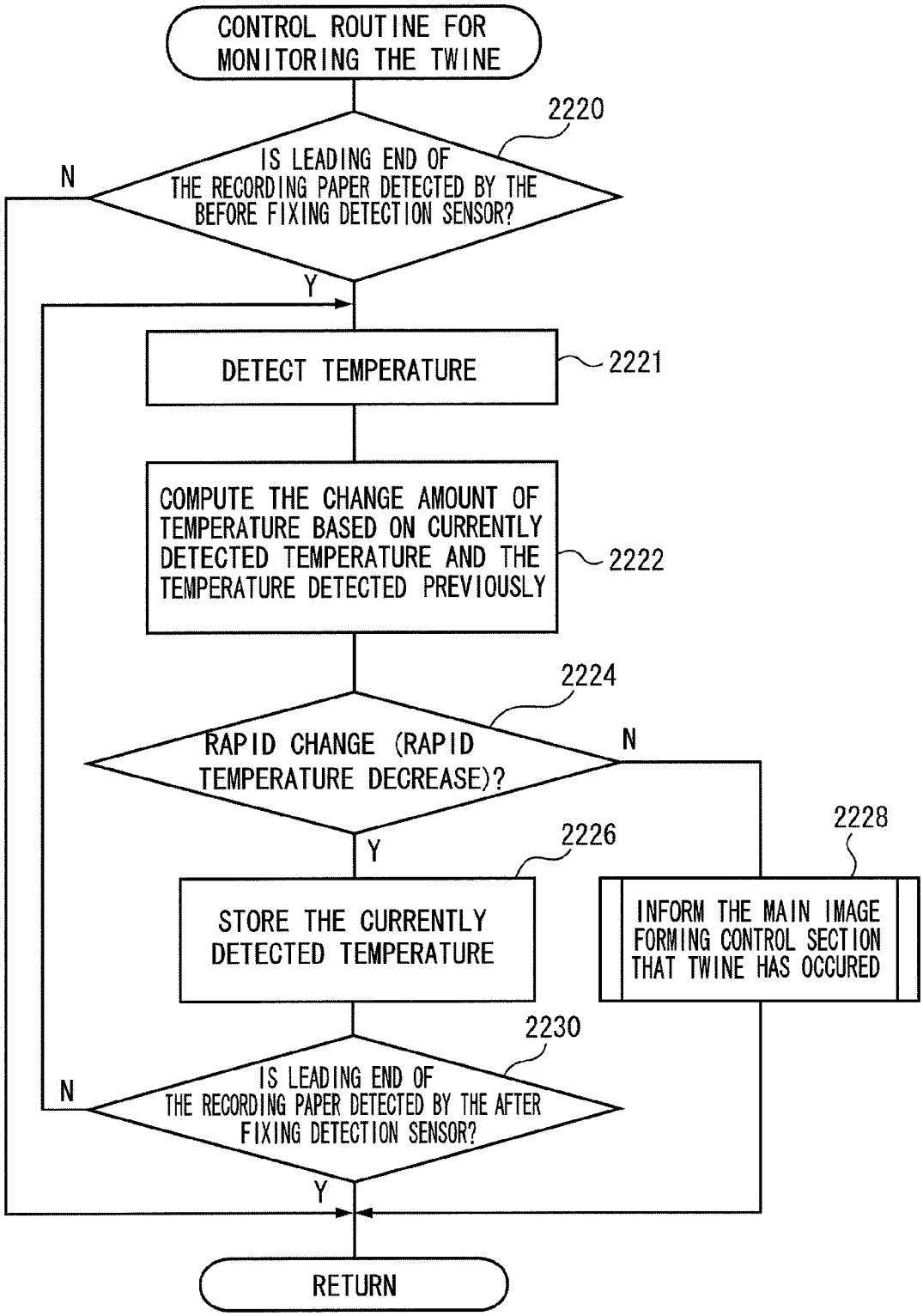
FIG. 13 is a flow chart showing control routine for monitoring a twine in the twine monitoring control section in accordance with the third exemplary embodiment.

FIG. 13 is a flow chart showing a control routine for monitoring the twine in the twine monitoring control section 130 of the fixing control section 122.

At step 2220, whether the leading end of the recording paper 30 is detected by the before fixing detection sensor 32D is determined. If an affirmative determination is output, the step proceeds to step 2221. If negative determination is output by the step 2220, this routine finishes.

At step 2221, the temperature by the temperature sensor 126 is detected, and the step proceeds to step 2222. At step 2222, the absolute value of the temperature change amount is computed based on the currently detected temperature information, and the previously detected temperature information.

AT next step 2224, whether the absolute value of the computed temperature change amount indicates a rapid temperature decrease is determined. If a negative determination (a normal determination) is output in the step 2224, the step proceeds to step 2226, and stores the currently detected temperature information. Then the routine proceeds to step 2230.

At step 2230, whether the leading end of the recording paper 30 is detected by the after fixing detection sensor 32E is determined. If a negative determination is output, the step returns to step 2221, and the step mentioned above will be repeated. Further, if an affirmative determination is output in step 2230, this routine finishes and the twine monitoring control finishes.

On the other hand, if an affirmative determination is output (the abnormal transport is determined) in step 2224, the step proceeds to step 2228, and outputs the twine abnormal transport generation signal to the image forming main control section 102. Thereafter, this routine finishes.

In this case, the image forming main control section 102 informed the twine displays that the abnormal transport has occurred by using the GUI 124, generates the alarm and instructs the respective control sections to stop the image forming process execution.

Figure 14:
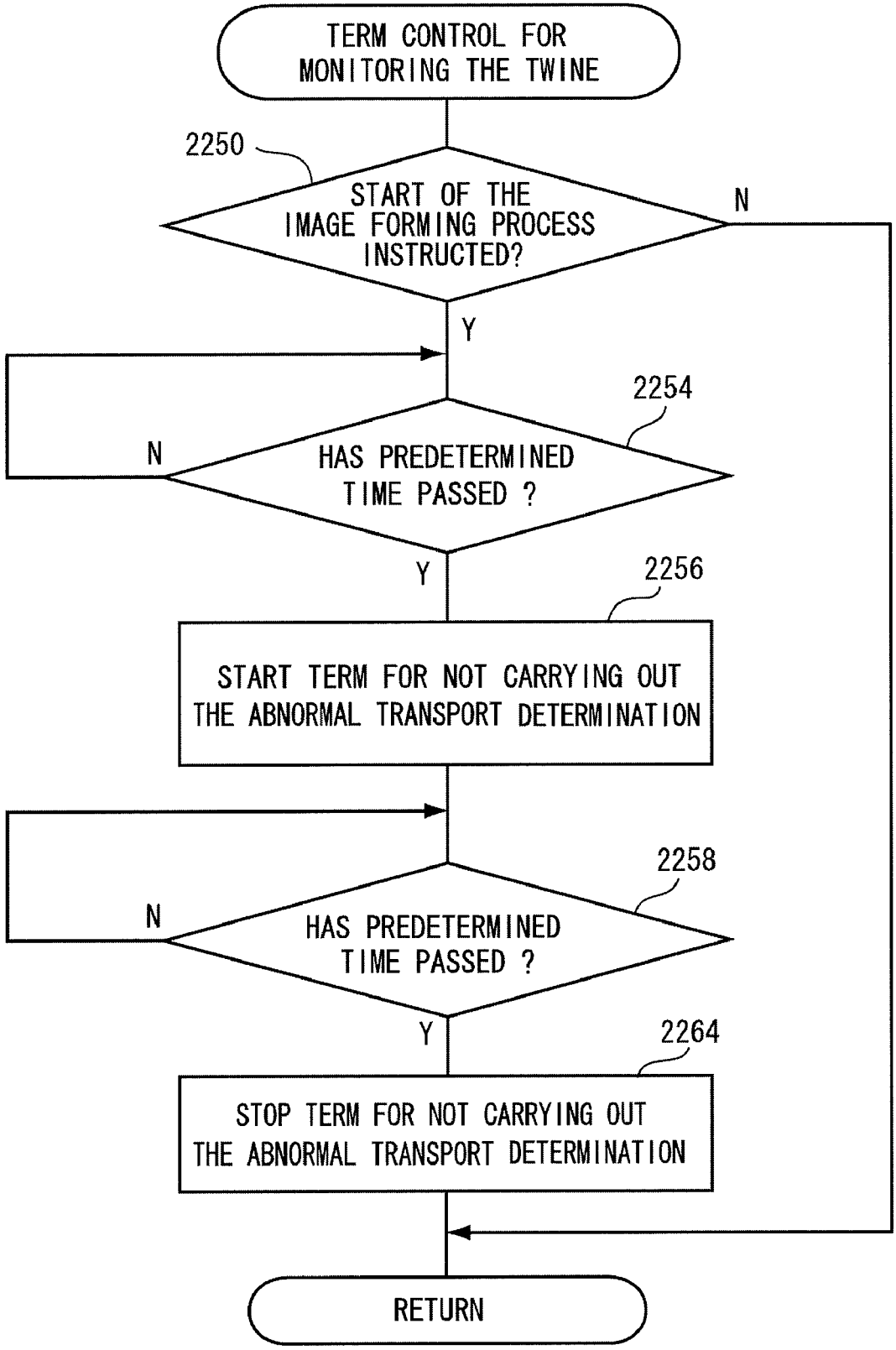
FIG. 14 is a flow chart showing a routine for term control for monitoring a twine in the twine monitoring control section in FIG. 13.

FIG. 14 is a routine for term control for monitoring the twine in the twine monitoring control section 130 as described in the flow chart of FIG. 13 mentioned above.

At step 2250, it is determined whether the image forming start instruction has been performed; that is, whether the processing mode has been established. If a negative determination is output, this routine finishes.

If an affirmative determination is output in step 2250, the step proceeds to step 2254, and determines whether a predetermined time has passed (the predetermined time corresponding to the time until when the recording paper 30 reaches the fixing section 42 after the image forming process).

If an affirmative determination is output in step 2254, the step proceeds to step 2256, and starts the term not to carry out the abnormal transport determination.

Based on the start of the term not to carry out the abnormal transport determination, the twine monitoring control in FIG. 13 temporarily comes to a non-executable state.

At next step 2258, whether a predetermined time has passed is determined. The predetermined time in this step 2258 corresponds to the previously set term not to carry out the abnormal transport determination, and this term may be different in accordance with a process speed. The process speed is a processing time based on a transport speed of the recording paper 30, a light scanning speed of a light scanning apparatus and the like.

If an affirmative determination is output in the step 2258, the step stops the term not carry to out the abnormal transport determination, and this routine finishes. In other words, the term not to carry out the abnormal transport determination continues during the negative determination in the step 2258.

The twine monitoring control in FIG. 13 restarts when the term not to carry out the abnormal transport determination ends (comes to an executable state).

In the third exemplary embodiment, a start time of the period not to carry out the abnormal transport determination is set to the predetermined time from the image forming process start instruction, and a stop time of the term not to carry out the abnormal transport determination is set based on a time corresponding to a job (a processing amount). However, the structure is not particularly limited to this. The term not to carry out the abnormal transport determination may be set based on the other timings as far as the temperature decrease generated by the contact between the heating roller 42B and the pressurizing roller 42C can be excluded from the twine monitoring.

Further, in the third exemplary embodiment, the twine monitoring control is set from the image forming process start instruction time to the time of detecting the leading end of the recording paper 30 by the after fixing detection sensor 32E. However, the structure may be made to be monitored in all the region of the image forming mode.

Further, the abnormal transport determination is not executed completely for the term not to carry out the abnormal transport determination. However, for example, it is possible to change the value of the absolute value |T's| of the reference temperature change to such a degree in order to not to determine the abnormal transport, for a predetermined term including the contact time between the heating roller 42B and the pressurizing roller 42C (it is possible to blunt the edge of the abnormal transport determination).

Figure 15:
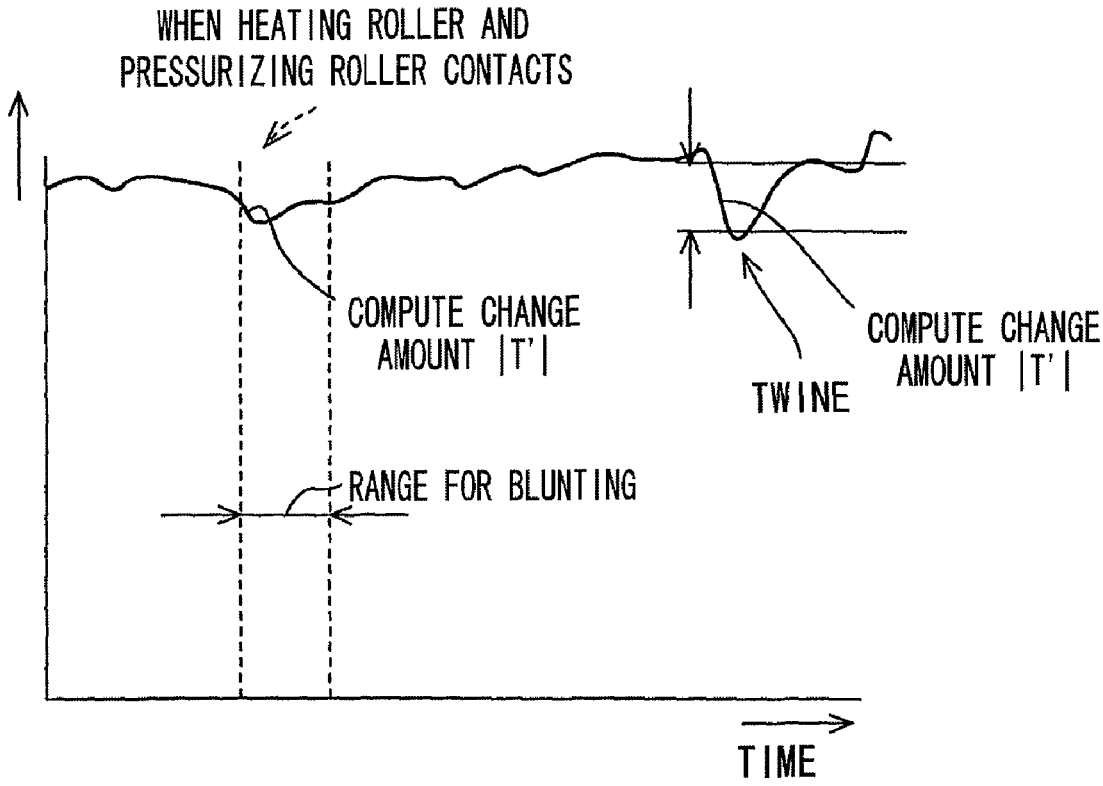
FIG. 15 is a timing chart for a temperature control and a twine start control in accordance with a modified exemplary embodiment.

Describing with reference to FIG. 15, a time of a hatched range in FIG. 15 is originally the contact time between the heating roller 42B and the pressurizing roller 42C, where the temperature decrease (the temperature change) is generated. However, it is possible to suppress the absolute value of the change amount to be prevented from reaching the absolute value of the reference temperature change amount, by transporting out a so-called rounding correction (in other words, adding a predetermined amount to the numerical value of the absolute value |T's|), at a time of computing the absolute value of the temperature change amount. Accordingly, it is possible to prevent from erroneously determining the contact time between the heating roller 42B and the pressurizing roller 42C as the twine generation. In this case, in place of blunting the edge of the detection data, the structure may be made to round the absolute value of the reference temperature change amount (in other words, subtract a predetermined amount from the absolute value of the temperature change amount: which is originally determined as the twine, however, is changed to a level which is not determined as the twine), during the hatched range in FIG. 15.

The twine is monitored for the predetermined term in this case. However, this case may belong to the category of the definition of "term not to detect" as mentioned in the third exemplary embodiment.

Further, in the third exemplary embodiment, the temperature decrease is determined based on the absolute value of the temperature change amount. However, the abnormal temperature decrease may be determined by comparing the temperature rate of the temperature decrease with a predetermined threshold value. In this case, the temperature detection by the temperature sensor 126 may be canceled, or the comparison between the detected temperature and the threshold value may be canceled, during the contact between the heating roller 42B and the pressurizing roller 42C.

Further, in the third exemplary embodiment, the configuration is made to detect whether the recording paper 30 has twined around the heating roller 42B. However, it is possible to forecast whether the recording paper 30 has twined around the pressurizing roller 42C unwontedly, and is possible to arrange the temperature sensor 126A corresponding to the pressurizing roller 42C, as shown in FIG. 2.

Further, in the third exemplary embodiment, the material, the thickness and the like of the recording paper 30 are not referred. However, in the case of taking into consideration the matter that the recording paper 30 absorbs the heat from the heating roller 42B, the structure is made to correct the start/end time of the term not to detect, or the reference value (the threshold value) compared with the absolute value of the computed temperature change amount or the detected temperature, based on the material, the thickness or the like of the recording paper 30.

Specifically, in the ROM 108 and the RAM 106, there is stored a correction value for correcting the start/end time of the term not to detect, the absolute value of the computed temperature change, the detected temperature, and the reference value (the threshold value) for comparison per the material of the recording medium 30, or the thickness and the material of the recording medium 30. A correcting section (not shown) corrects the correction value corresponding to the material of the recording medium 30 and the thickness of the recording medium 30, and the start/end time of the term not to detect, and the reference value (the threshold value) by acquiring the correction value by an acquiring section (not shown). In other words, the thicker the recording medium is, or the higher the heat absorption rate is, the greater the temperature decrease is generated when the twine occurs. Accordingly, in the case mentioned above, the correction is made in order to make the determination of the twine of the recording paper 30 more difficult. The correcting section is used as one example of the correcting section.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing apparatus comprising:

a pair of rotating bodies that transports a recording medium on which an image is formed by using an image forming material, by sandwiching the recording medium;

a heating section that heats at least one of the pair of rotating bodies;

a moving section that moves the pair of rotating bodies between a position at which they mutually contact and a position at which they are mutually separated;

a temperature detecting section that detects a surface temperature of at least one of the pair of rotating bodies without contacting the rotating bodies; and a twine generation determining section that determines whether the recording medium has twined around either one of the pair of rotating bodies based on a rate of temperature increase after a temperature decrease of the surface temperature detected by the temperature detecting section, wherein the twine generation determining section determines that the recording medium has twined around either of the pair of rotating bodies when a rate of temperature increase of the surface temperature is greater than a previously set first reference value, wherein the twine generation determining section determines whether the temperature decrease is caused by the twine of the recording medium around either one of the pair of rotating bodies, or is caused by the contact of the pair of rotating bodies, based on a rate of temperature increase.

2. The fixing apparatus of claim 1, wherein the twine generation determining section determines whether the recording medium has twined around either of the pair of rotating bodies based on a rate of temperature decrease of the surface temperature, and a rate of temperature increase of the surface temperature after the temperature decrease of the surface temperature.

3. The fixing apparatus of claim 2, wherein the twine generation determining section determines that the recording medium has twined around either of the a pair of rotating bodies when a value, obtained by adding a rate of temperature increase of the surface temperature to a rate of temperature decrease of the surface temperature, is equal to or greater than a previously set second reference value.

4. The fixing apparatus of claim 3, further comprising:

a correction value acquiring section that acquires a correction value based on a material of the recording medium or a thickness of the recording medium; and a correcting section that corrects the first reference value or the second reference value based on the correction value acquired by the correction value acquiring section.

5. The fixing apparatus of claim 4, wherein the twine generation determining section determines that the recording medium has twined around either of the pair of rotating bodies when a rate of temperature increase of the surface temperature is less than a previously set third reference value.

6. A printing apparatus comprising:

an image forming section that forms an image on a recording medium by using an image forming material;

a pair of rotating bodies that transports the recording medium on which the image is formed by sandwiching the recording medium;

a heating section that heats at least one of the pair of rotating bodies;

a moving section that moves the pair of rotating bodies between a position at which they mutually contact and a position at which they are mutually separated;

a temperature detecting section that detects a surface temperature of at least one of the pair of rotating bodies without contacting the rotating bodies; and a twine generation determining section that determines whether the recording medium has twined around either of the pair of rotating bodies based on a rate of temperature increase after a temperature decrease of the surface temperature detected by the temperature detecting section, wherein the twine generation determining section determines that the recording medium has twined around either of the pair of rotating bodies when a rate of temperature increase of the surface temperature is greater than a previously set first reference value, wherein the twine generation determining section determines whether the temperature decrease is caused by the twine of the recording medium around either one of the pair of rotating bodies, or is caused by the contact of the pair of rotating bodies, based on a rate of temperature increase.

7. A computer readable medium storing a program to execute a process for detecting twine, the process comprising:

transporting a recording medium by sandwiching it between a pair of rotating bodies, an image being formed on the recording medium by using an image forming material;

heating at least one of the pair of rotating bodies;

moving the pair of rotating bodies between a position at which they mutually contact and a position at which they are mutually separated;

detecting a surface temperature of at least one of the pair of rotating bodies without contacting the rotating bodies; and determining whether the recording medium has twined around either of the pair of rotating bodies based on a rate of a temperature increase after a temperature decrease of the surface temperature detected by the temperature detecting step, wherein it is determined whether the recording medium has twined around either of the pair of rotating bodies when a rate of temperature increase of the surface temperature is greater than a previously set first reference value, wherein it is determined whether the temperature decrease is caused by the twine of the recording medium around either one of the pair of rotating bodies, or is caused by the contact of the pair of rotating bodies, based on a rate of temperature increase.

* * * * *